US011804677B2

(12) United States Patent
Maesoba et al.

(10) Patent No.: US 11,804,677 B2
(45) Date of Patent: Oct. 31, 2023

(54) ELECTRICAL TERMINAL MODULE AND CONNECTOR WITH IMPROVED SHIELDING FEATURES

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 239 days.

(21) Appl. No.: 17/418,452

(22) PCT Filed: Dec. 23, 2019

(86) PCT No.: PCT/JP2019/050331
§ 371 (c)(1),
(2) Date: Jun. 25, 2021

(87) PCT Pub. No.: WO2020/137965
PCT Pub. Date: Jul. 2, 2020

(65) Prior Publication Data

US 2021/0399499 A1 Dec. 23, 2021

(30) Foreign Application Priority Data

Dec. 28, 2018 (JP) ..... 2018-247607

(51) Int. Cl.
*H01R 13/6592* (2011.01)
*H01B 7/18* (2006.01)
(Continued)

(52) U.S. Cl.
CPC ..... *H01R 13/6592* (2013.01); *H01B 7/18* (2013.01); *H01R 13/502* (2013.01);
(Continued)

(58) Field of Classification Search
CPC ..... H01R 13/6592; H01R 13/502; H01R 13/506; H01R 13/6582; H01R 13/65912;
(Continued)

(56) References Cited

U.S. PATENT DOCUMENTS 8,926,368 B2 1/2015 Il
2019/0312388 A1 10/2019 Maesoba et al.
(Continued)

FOREIGN PATENT DOCUMENTS

JP 2017-098081 A 6/2017

OTHER PUBLICATIONS

International Search Report issued on Mar. 17, 2020 for WO 2020/137965 A1 (4 pages).

*Primary Examiner* — Abdullah A Riyami
*Assistant Examiner* — Justin M Kratt
(74) *Attorney, Agent, or Firm* — Venjuris, P.C.

(57) ABSTRACT

A terminal module is provided with a shielded cable including at least one coated wire, a conductive shield portion and a sheath portion for covering an outer periphery of the shield portion; an inner conductor to be connected to the coated wire, a terminal accommodating member made of resin for accommodating the inner conductor; a first outer conductor made of metal and including a tubular portion for accommodating the terminal accommodating member; and a second outer conductor made of metal and including a covering
(Continued)

portion for covering a back end part of the tubular portion of the first outer conductor. A narrowing portion is provided in the back end part of the first outer conductor. The terminal accommodating member includes an escaping portion for avoiding interference with the narrowing portion in the process of accommodating the terminal accommodating member into the tubular portion.

3 Claims, 23 Drawing Sheets

(51) Int. Cl.

| | |
|---|---|
| ***H01R 13/502*** | (2006.01) |
| ***H01R 13/516*** | (2006.01) |
| ***H01R 13/6582*** | (2011.01) |
| ***H01R 13/6593*** | (2011.01) |
| ***H01R 13/6591*** | (2011.01) |
| ***H01R 13/506*** | (2006.01) |
| *H01R 4/18* | (2006.01) |
| *H01R 4/10* | (2006.01) |

(52) U.S. Cl.
CPC ..... *H01R 13/506* (2013.01); *H01R 13/516* (2013.01); *H01R 13/6582* (2013.01); *H01R 13/6593* (2013.01); *H01R 13/65912* (2020.08); *H01R 13/65914* (2020.08); *H01R 4/10* (2013.01); *H01R 4/18* (2013.01); *H01R 13/5025* (2013.01); *H01R 13/6591* (2013.01); *H01R 13/65915* (2020.08)

(58) Field of Classification Search
CPC ..... H01R 13/65914; H01R 13/6593; H01R 4/10; H01R 4/18; H01R 13/5025; H01R 13/6591; H01R 13/65915; H01B 7/18
See application file for complete search history.

(56) References Cited

U.S. PATENT DOCUMENTS

2019/0319389 A1 10/2019 Hara et al.
2019/0386435 A1* 12/2019 Takahashi ..... H01R 13/6581

* cited by examiner

ELECTRICAL TERMINAL MODULE AND CONNECTOR WITH IMPROVED SHIELDING FEATURES

CROSS REFERENCE TO RELATED APPLICATIONS

This application is a national phase of PCT application No. PCT/JP2019/050331, filed on 23 Dec. 2019, which claims priority from Japanese patent application No. 2018-247607, filed on 28 Dec. 2018, all of which are incorporated herein by reference.

TECHNICAL FIELD

A technique disclosed by this specification relates to a terminal module and a connector.

BACKGROUND

A shield connector connected to an end of a shielded cable for transmitting a communication signal is, for example, known from Japanese Unexamined Patent Publication No. 2013-229255 (Patent Document 1 below). This shield connector includes a male terminal to be connected to a shield wire exposed by stripping a shield foil and a sheath portion of the shielded cable, an inner housing for accommodating the male terminal, a shield shell including a tubular portion for covering the inner housing and to be connected to the shield foil of the shielded cable, and a shield shell cover for covering the shield shell.

In assembling the shield connector, a terminal module in which the male terminal is accommodated in the inner housing is first configured by inserting the male terminal crimped and connected to the shield wire into the inner housing. Then, the terminal module is inserted into the tubular portion through an insertion portion provided in a back end part of the shield shell, and the shield shell cover is mounted to cover the insertion portion of the shield shell from above.

PRIOR ART DOCUMENT

Patent Document

Patent Document 1: JP 2013-229255 A

SUMMARY OF THE INVENTION

Problems to be Solved

In the connector of this type, the shield wire exposed by stripping the end of the shielded cable is covered by the shield shell and the shield shell cover. However, if a clearance between the shield shell and the shield shell cover is large, communication quality is reduced due to the leakage of noise and the entrance of noise from outside through the clearance. Thus, it has been studied to form a narrowing portion by narrowing an end part of the tubular portion of the shield shell radially inwardly and reduce the clearance between the shield shell and the shield shell cover by mounting the shell cover along the narrowing portion.

However, if the narrowing portion is formed in the end part of the tubular portion, the assembling workability of the inner housing with the shield shell is deteriorated, such as due to the interference of the narrowing portion and the inner housing in inserting the inner housing into the tubular portion through the insertion portion.

A technique for suppressing the deterioration of assembling workability while suppressing a reduction in communication quality is disclosed in this specification.

Means to Solve the Problem

The technique disclosed in this specification is directed to a terminal module with a shielded cable including at least one coated wire, a conductive shield portion for covering an outer periphery of the coated wire and a sheath portion for covering an outer periphery of the shield portion, an inner conductor to be connected to the coated wire, a terminal accommodating member made of resin for accommodating the inner conductor, the coated wire extending out from the terminal accommodating member, a first outer conductor made of metal and including a tubular portion for accommodating the terminal accommodating member, the coated wire extending out from the tubular portion, and a second outer conductor made of metal and including a covering portion for covering an end part of the tubular portion of the first outer conductor on a side where the coated wire is pulled out, wherein a narrowing portion disposed along an inner peripheral surface of the covering portion of the second outer conductor and extending toward an axis of the tubular portion along a direction in which the coated wire is extending out is provided in the end part of the first outer conductor, and the terminal accommodating member includes an escaping portion provided by recessing an outer surface of the terminal accommodating member, the escaping portion avoiding interference with the narrowing portion in the process of accommodating the terminal accommodating member into the tubular portion.

Further, the technique disclosed in this specification is directed to a connector with the above terminal module and a housing for accommodating the terminal module.

According to the terminal module thus configured, since the covering portion of the second outer conductor can be arranged along the narrowing portion of the first outer conductor, it is possible to suppress the leakage of noise and the entrance of noise from outside through a clearance among the end part of the tubular portion of the first outer conductor, the narrowing portion and the covering portion of the second outer conductor. In this way, a reduction in communication quality can be suppressed in the terminal module.

Further, since the terminal accommodating member is provided with the escaping portion, the interference of the narrowing portion and the terminal accommodating member can be avoided in the process of the accommodating the terminal accommodating member into the tubular portion of the first outer conductor. In this way, it is possible to suppress the deterioration of assembling workability in assembling the terminal accommodating member with the first outer conductor.

The terminal module disclosed by this specification may be configured as follows.

The tubular portion may be formed into a rectangular tube shape and the narrowing portion may be roundly formed to be continuous with an angle part of the tubular portion, the terminal accommodating member may be formed into a rectangular column shape, and the escaping portion may be formed along an inserting direction of the terminal accommodating member in a corner part of the terminal accommodating member on the narrowing portion side.

Generally, if an end part of a tubular portion in the form of a rectangular tube is covered by a covering portion, clearances are easily formed between angle parts of the tubular portion and the covering portion. However, according to the above configuration, since the narrowing portion is roundly formed in the end part of the angle part of the tubular portion, the clearance among the end part of the tubular portion, the narrowing portion and the covering portion can be reduced. In this way, it is possible to suppress the leakage of noise and the entrance of noise from outside through the clearance among the end part of the tubular portion, the narrowing portion and the covering portion and suppress a reduction in communication quality.

Further, since the escaping portion is roundly provided in the corner part on the narrowing portion side in the terminal accommodating member, the escaping portion can double as an erroneous assembling preventing portion for preventing so-called erroneous assembling such as the assembling of the vertically inverted terminal accommodating member.

Effect of the Invention

According to the technique disclosed by this specification, it is possible to suppress the deterioration of assembling workability while suppressing a reduction in communication quality.

DETAILED DESCRIPTION TO EXECUTE THE INVENTION

Embodiment

Figure 1:
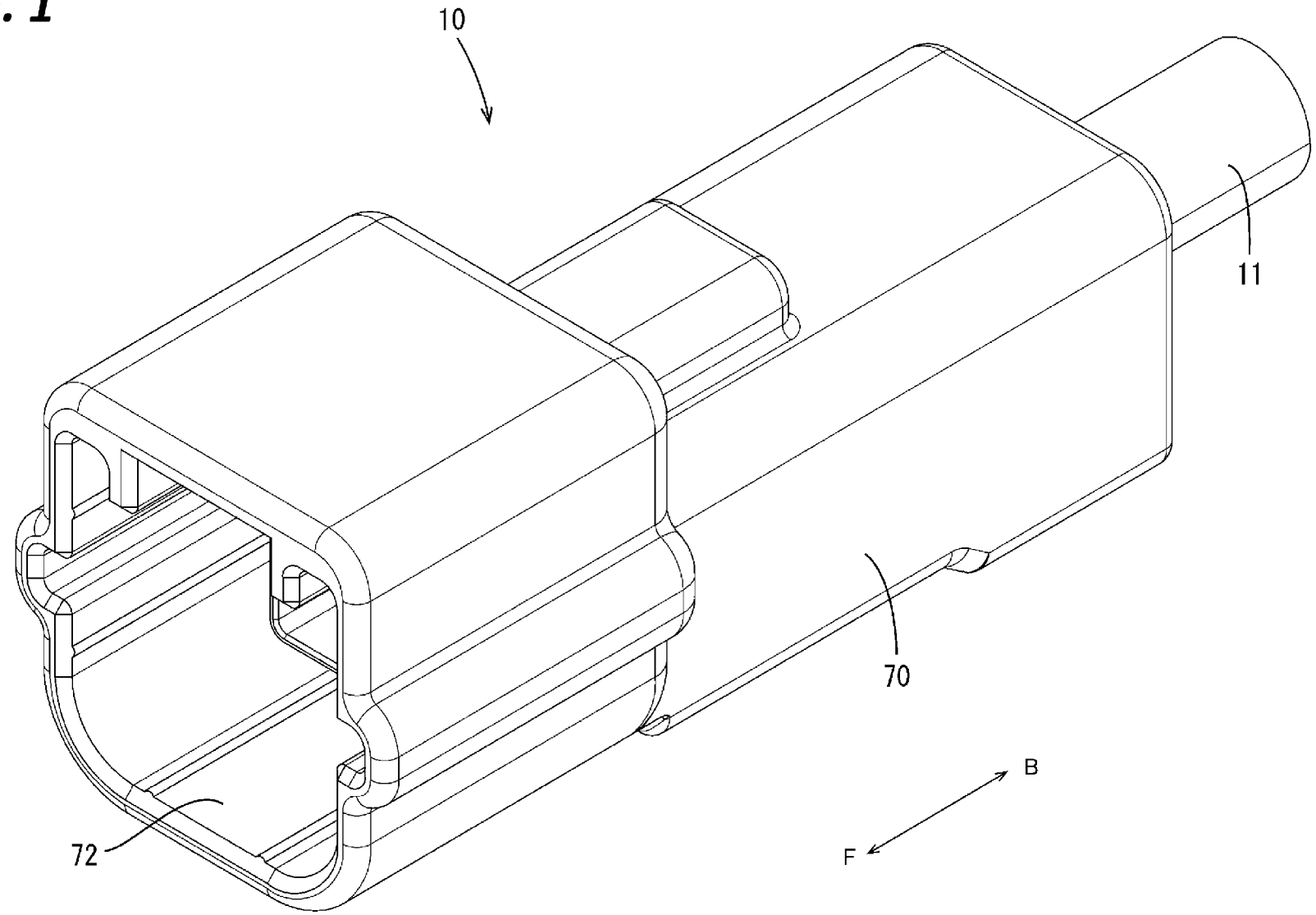
FIG. 1 is a perspective view of a connector according to an embodiment.
Figure 2:
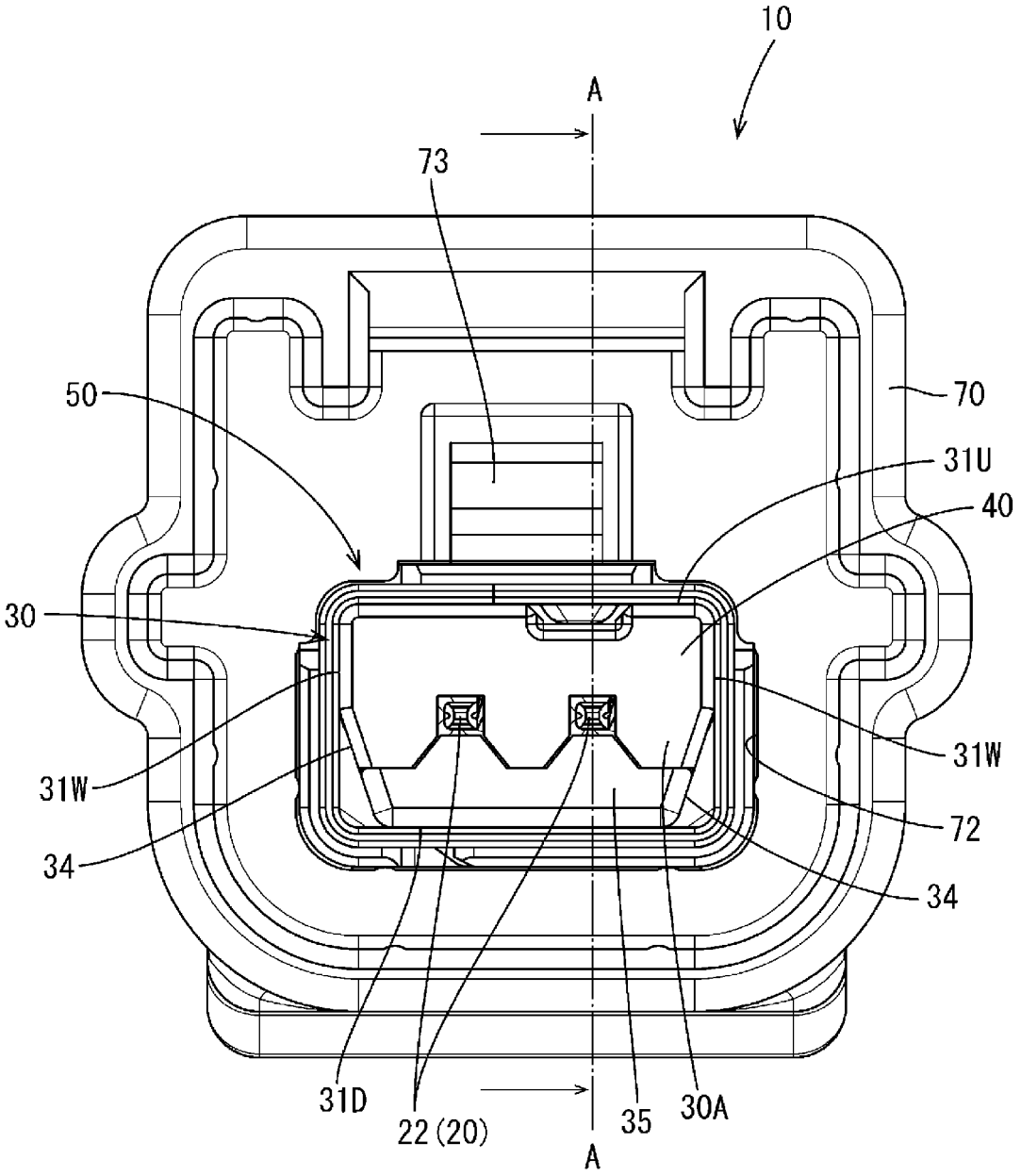
FIG. 2 is a front view of the connector.

One embodiment of the technique disclosed in this specification is described with reference to FIGS. 1 to 23.

A connector 10 for communication to be installed, for example, in a vehicle such an electric vehicle or hybrid vehicle and disposed in a wired communication path, for example, between an in-vehicle electrical component (car navigation system, ETC, monitor or the like) in the vehicle and an external device (camera or the like) or between in-vehicle electrical components is illustrated in this embodiment. Note that, in the following description, an F-side means a front side and a B-side means a back side.

As shown in FIGS. 1 to 4, the connector 10 includes a shielded cable 11, a plurality of inner conductors 20 to be connected to a front end of the shielded cable 11, a terminal accommodating member 30 for accommodating the plurality of inner conductors 20, an outer conductor 50 to be connected to the shielded cable 11 while covering the outer periphery of the terminal accommodating member 30, and a housing 70 for accommodating the outer conductor 50.

The shielded cable 11 includes a plurality of coated wires 12, a shield portion 15 constituted by a braided wire for collectively covering the outer peripheries of the plurality of coated wires 12, and a sheath portion 16 constituted by an insulating coating for covering the outer periphery of the shield portion 15. In the shielded cable 11 of this embodiment, two coated wires 12 are collectively covered by the shield portion 15.

Each coated wire 12 is formed such that a conductive core 13 is covered by an insulating insulation coating 14. The two coated wires 12 are twisted in a state covered by the shield portion 15, and the sheath portion 16 is stripped in a front end part of the shielded cable 11 to expose the untwisted two coated wires 12 and the shield portion 15.

The shield portion 15 is formed by braiding a plurality of conductive metal thin wires into a tube. The shield portion 15 exposed from an end of the sheath portion 16 is folded on an end part of the sheath portion 16 to cover the outer periphery of the end part of the sheath portion 16, and this folded part of the shield portion 15 serves as a folded portion 15A.

In a front end part of each coated wire 12 pulled out forward from the folded portion 15A, the insulation coating 14 is stripped to expose the core 13, and the inner conductor 20 is electrically connected to the exposed core 13.

The inner conductor 20 is formed by working a conductive metal plate material by a press or the like. The inner conductor 20 is a so-called male terminal and includes a pin-like terminal connecting portion 22 and a wire connecting portion 24 connected behind the terminal connecting portion 22 and to be crimped and connected to the core 13 and an end of the insulation coating 14.

A part of the coated wire 12 exposed from the shield portion 15 between the inner conductor 20 and the folded portion 15A of the shield portion 15 serves as an exposed portion 17, and an adjusting member 80 for adjusting an impedance in the exposed portion 17 is mounted on the exposed portion 17.

The adjusting member 80 is formed by working a conductive metal plate material by a press or the like. The adjusting member 80 includes two adjusting bodies 82 to be respectively mounted on the outer peripheries of the exposed portions 17 in the coated wires 12 and a coupling portion 85 coupling the two adjusting bodies 82.

Each adjusting body 82 is formed into a substantially hollow cylindrical shape to cover the outer peripheral surface of the exposed portion 17 in a circumferential direction. The adjusting body 82 is mounted in a substantially central part in a front-back direction of the exposed portion 17, and a length in the front-back direction of the adjusting body 82 is somewhat shorter than that of the exposed portion 17.

Figure 12:
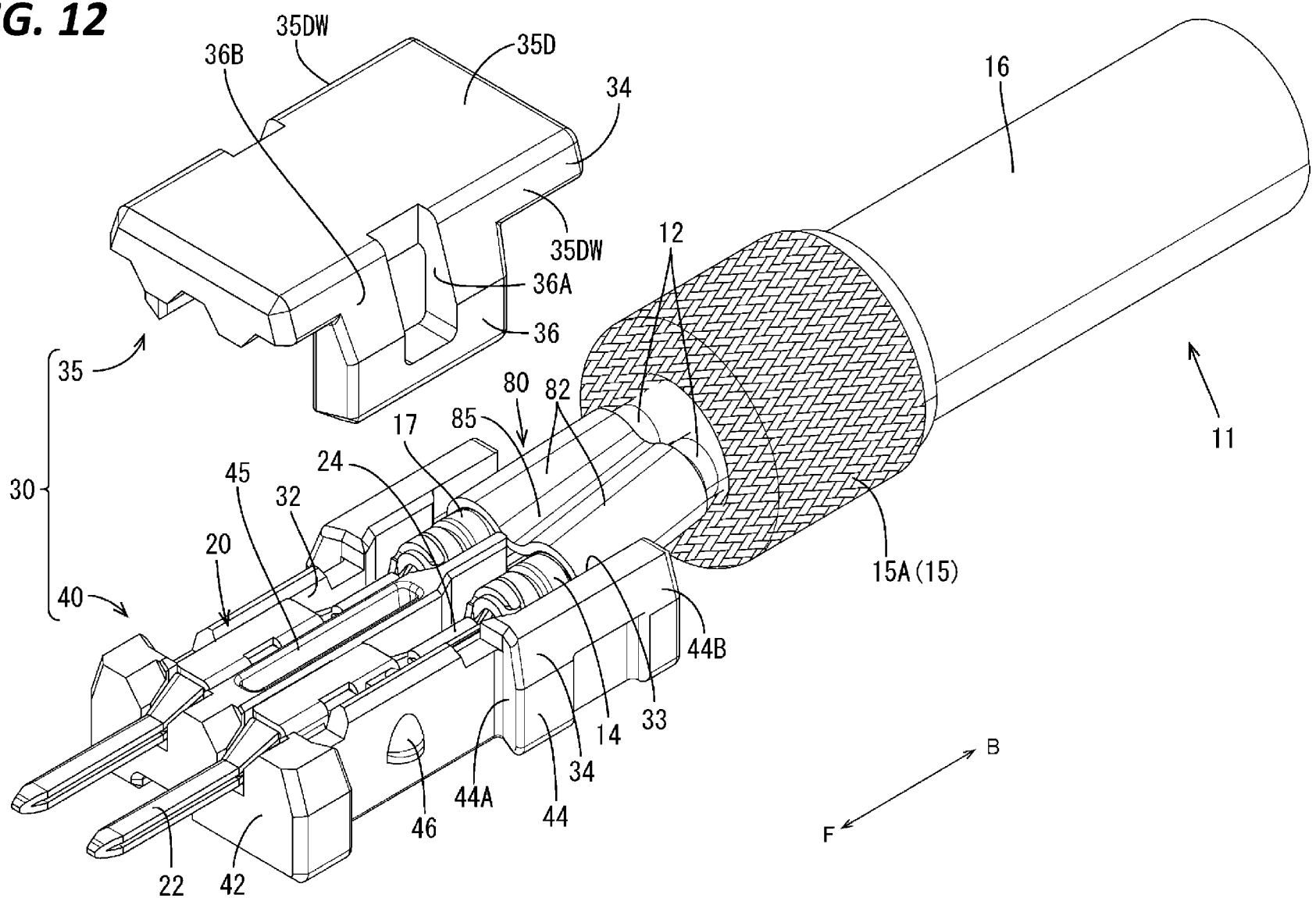
FIG. 12 is a perspective view showing a state before the lower member is assembled with the vertically inverted upper member having inner conductors mounted therein.

The coupling portion 85 is curved to bulge upward and couples the two adjusting bodies 82 in a lateral direction. Further, as shown in FIG. 12, the coupling portion 85 is formed to be laterally wider in a front part than in a back part. Thus, the adjusting member 80 is laterally wider in a front part than in a back part.

The terminal accommodating member 30 is made of synthetic resin and, as shown in FIGS. 12 to 16, in the form of a rectangular parallelepiped long in the front-back direction.

Figure 3:
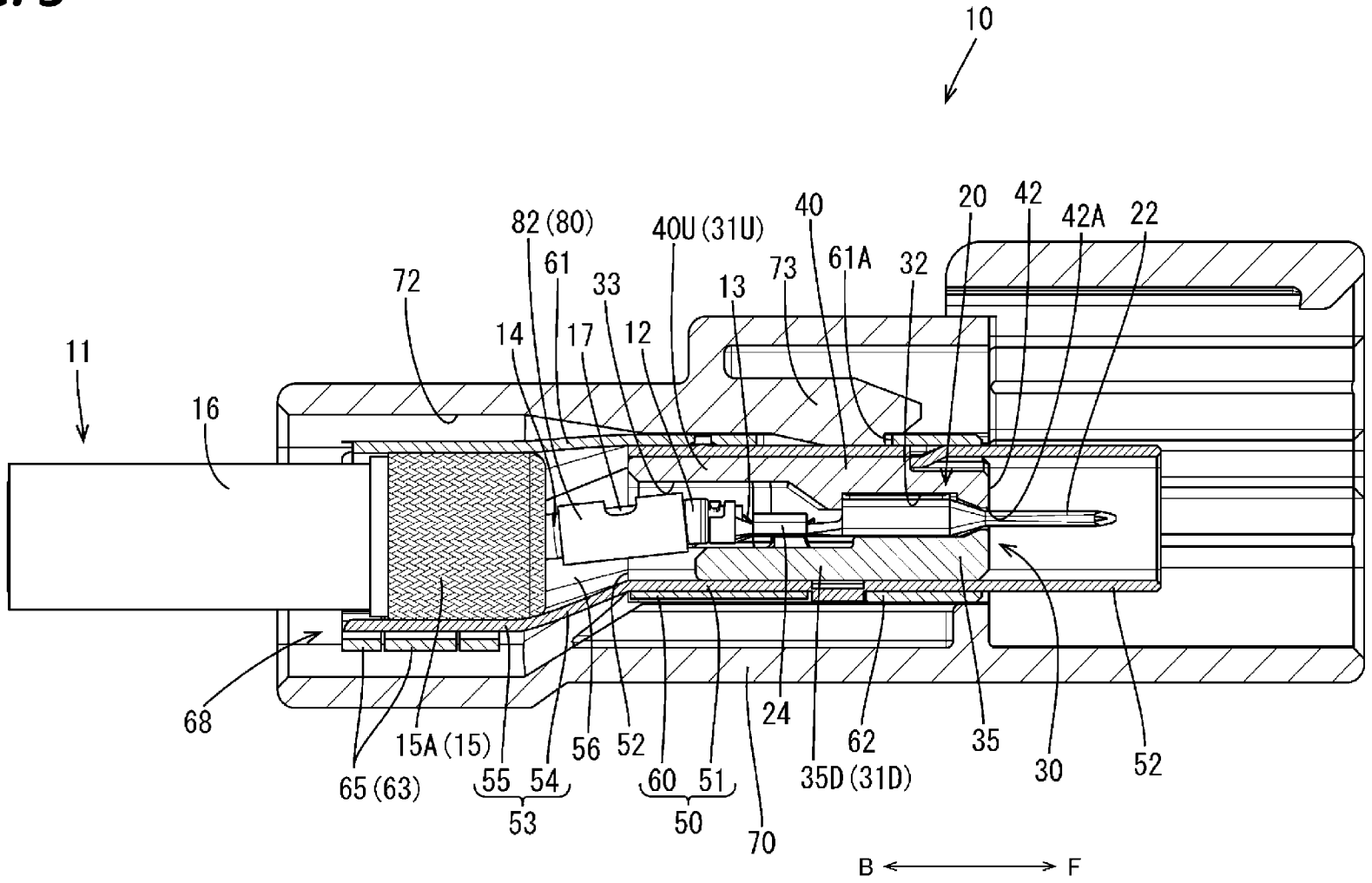
FIG. 3 is a section along A-A of FIG. 2.

Cavities 32 extending in the front-back direction are formed side by side in the lateral direction on a side of the terminal accommodating member 30 forward of a central part in the front-back direction. As shown in FIGS. 3 and 12, the inner conductors 20 connected to the coated wires 12 are accommodated in the respective cavities 32.

A back part of the terminal accommodating member 30 serves as a large accommodating portion 33 for accommodating the exposed portions 17 extending out backward from the two inner conductors 20 with the adjusting member 80 mounted.

Further, as shown in FIGS. 4 to 7 and 12 to 16, the terminal accommodating member 30 is configured by assembling a lower member 35 to be arranged in a lower part and an upper member 40 to be arranged in an upper part in a vertical direction.

Figure 4:
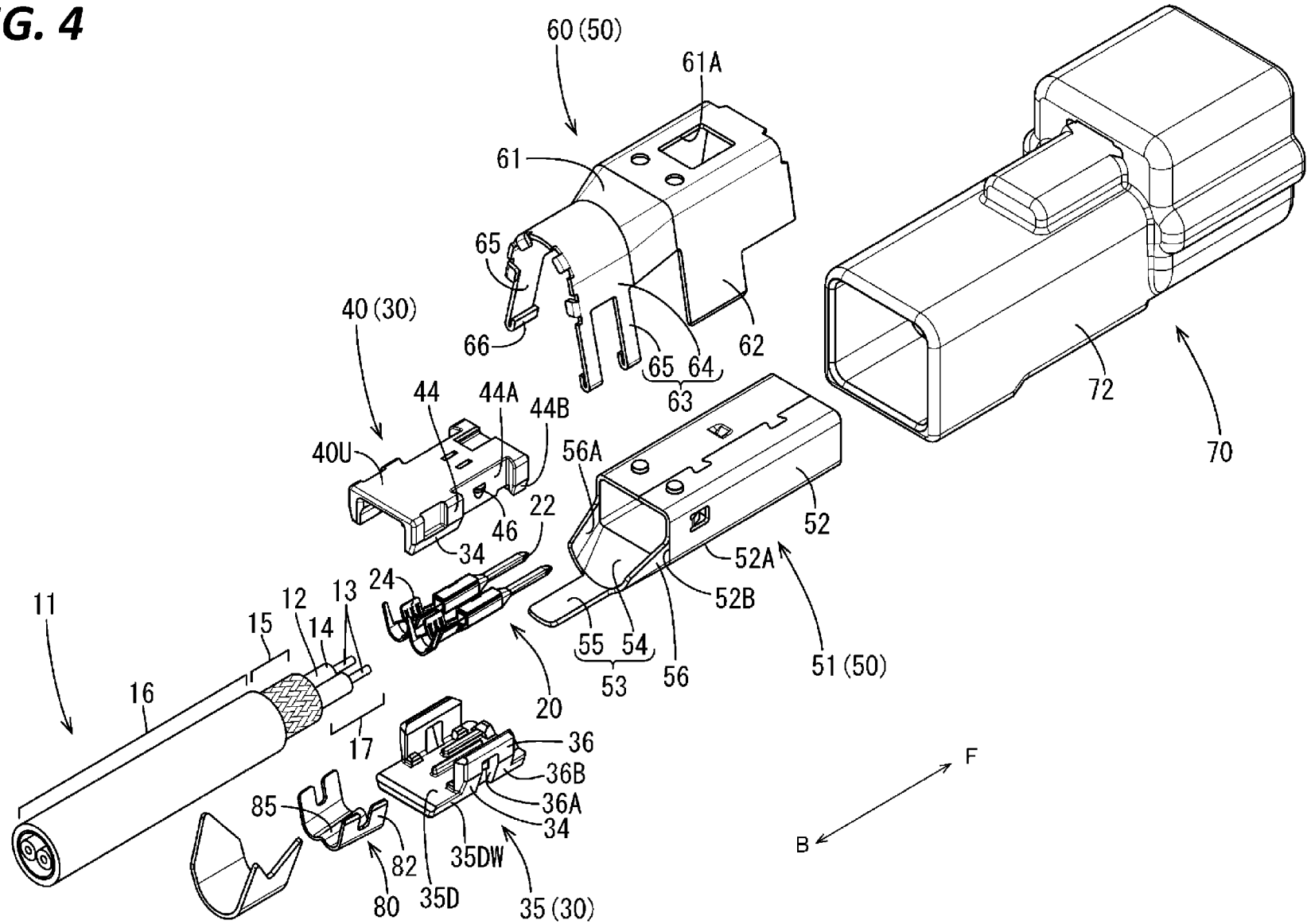
FIG. 4 is an exploded perspective view of the connector.
Figure 5:
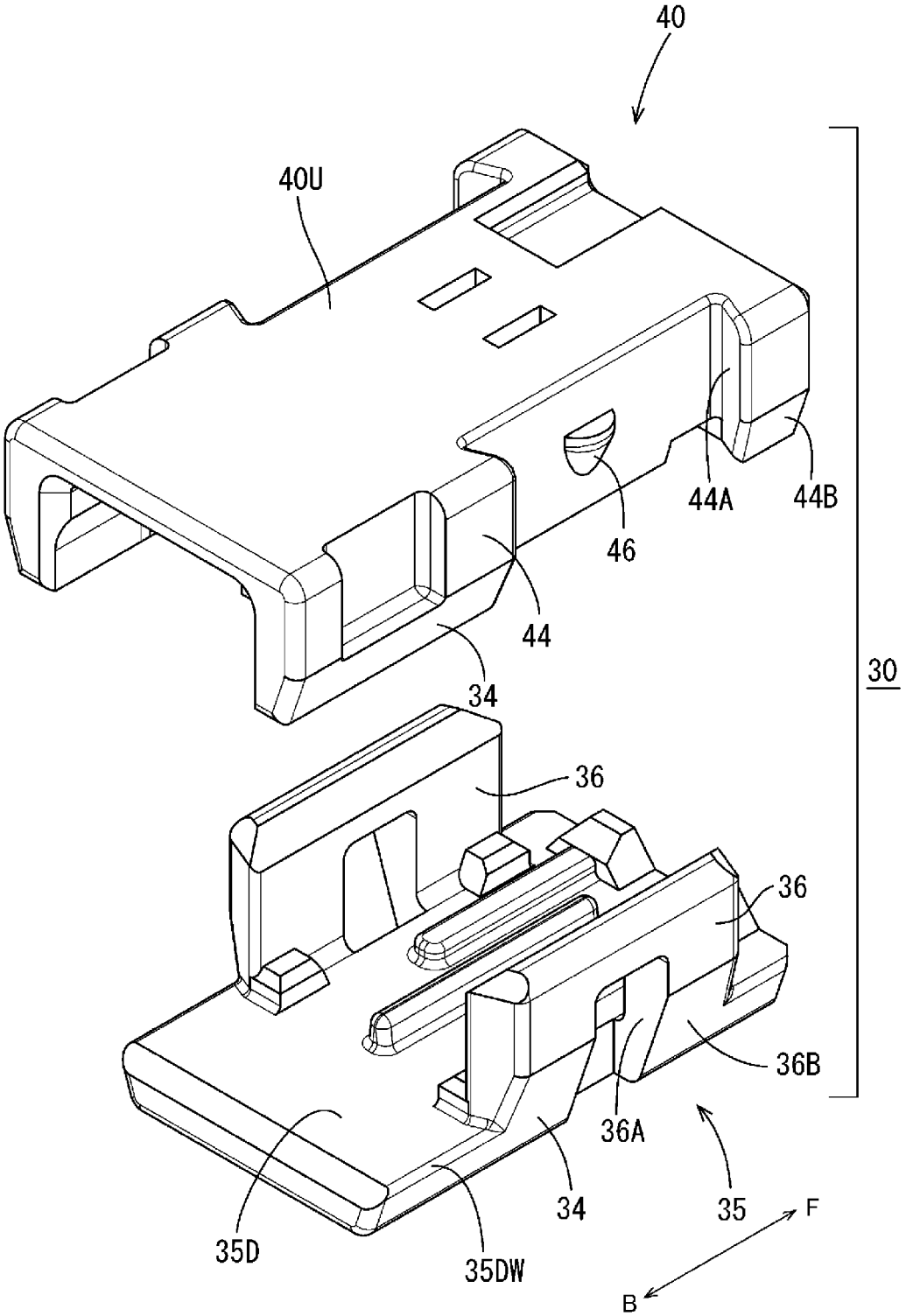
FIG. 5 is a perspective view showing a state before a lower member and an upper member are assembled.
Figure 6:
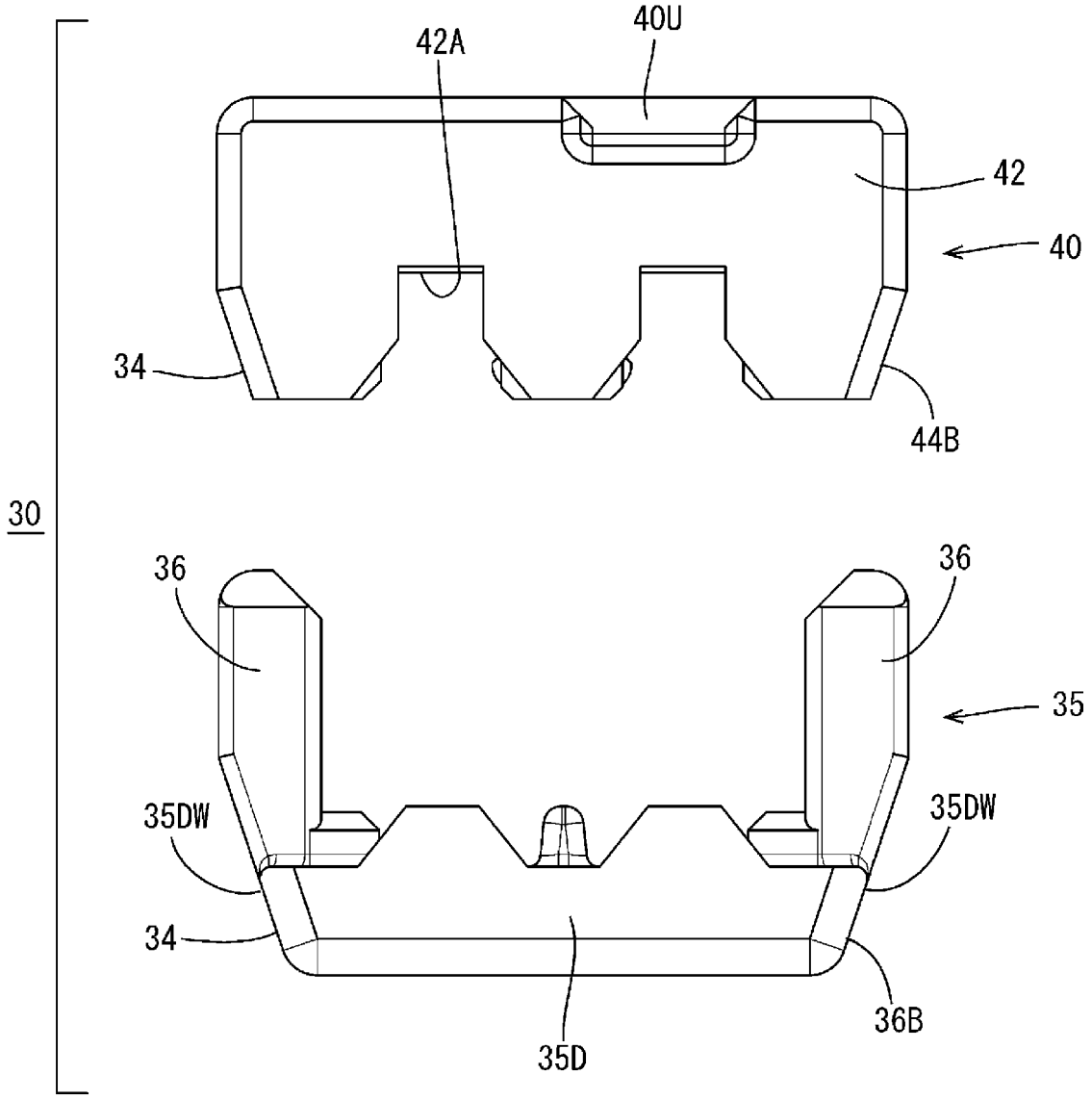
FIG. 6 is a front view showing the state before the lower member and the upper member are assembled.
Figure 7:
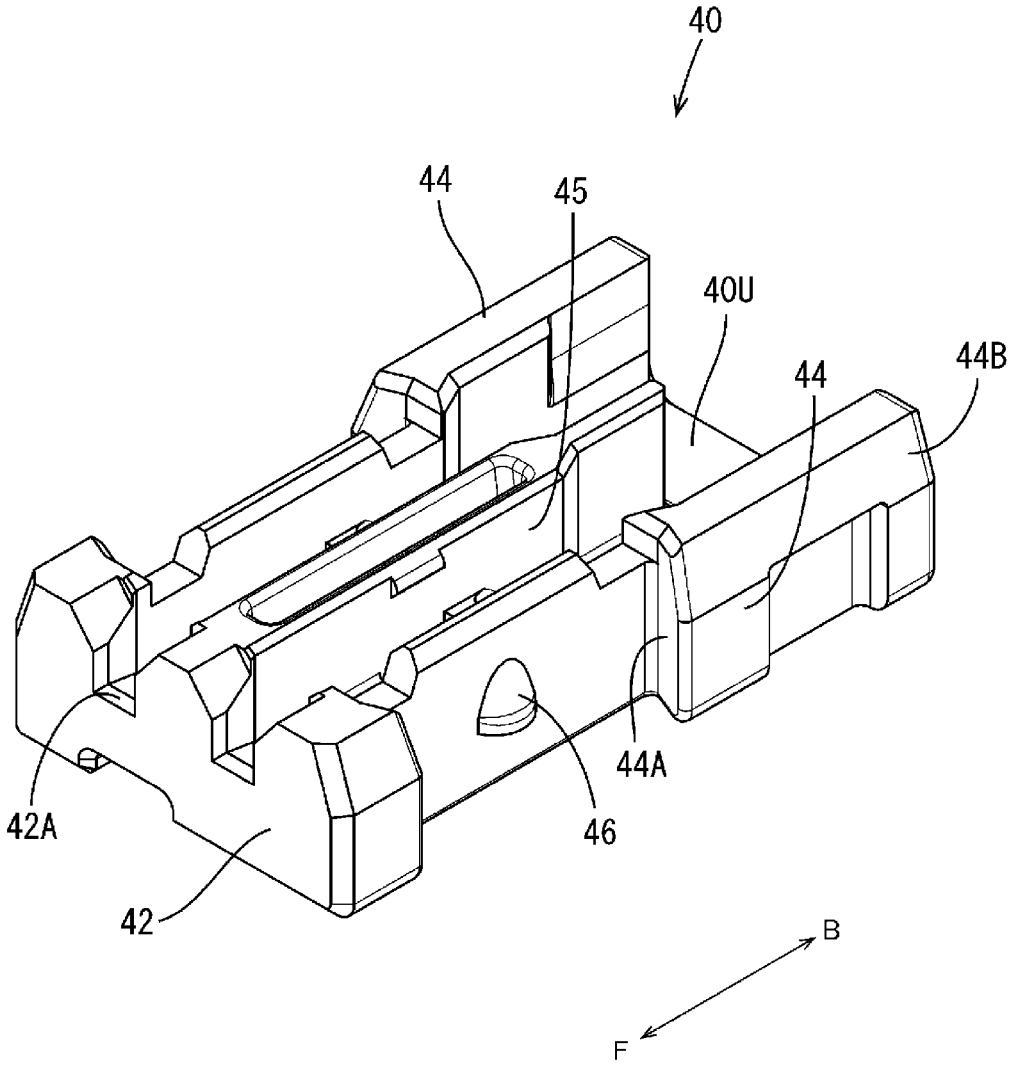
FIG. 7 is a side view showing the vertically inverted upper member.

As shown in FIGS. 4 to 6, the lower member 35 includes a bottom wall 35D constituting a lower wall 31D of the terminal accommodating member 30 and a pair of locking pieces 36 provided on both side edges 35DW of the bottom wall 35D. The bottom wall 35D is in the form of a substantially rectangular plate long in the front-back direction, and the two inner conductors 20 are placed side by side in the lateral direction on the bottom wall 35D.

The pair of locking pieces 36 are formed to extend upward in a substantially central part in the front-back direction of the bottom wall 35D, and each locking piece 36 includes a substantially rectangular locking hole 36A penetrating in the lateral direction.

As shown in FIGS. 4 to 7, the upper member 40 includes a ceiling wall 40U constituting an upper wall 31U of the terminal accommodating member 30, a front wall 42 provided on a front end part of the ceiling wall 40U and side walls 44 respectively provided on both lateral side edges of the ceiling wall 40U.

The ceiling wall 40U is in the form of a substantially rectangular flat plate long in the front-back direction, and dimensioned to cover the inner conductors 20 and the end parts of the coated wires 12 from a side opposite to the bottom wall 35D of the lower member 35. A separation wall 45 extending downward from the ceiling wall 40U is formed in a substantially central part in the lateral direction of the ceiling wall 40U. The separation wall 45 is disposed to be proximate to and vertically face the bottom wall 35D of the lower member 35 and the two cavities 32 for accommodating the inner conductors 20 are configured in the terminal accommodating member 30 when the upper member 40 and the lower member 35 are assembled.

The front wall 42 is in the form of a plate extending downward from the front end edge of the ceiling wall 40U and provided with insertion openings 42A into which the male terminals are inserted.

The pair of side walls 44 respectively extend downward from the ceiling wall 40U and are connected to both lateral side edges of the front wall 42.

A fitting recess 44A into which the locking piece 36 of the lower member 35 is fit when the upper member 40 and the lower member 35 are assembled is formed in a substantially central part in the front-back direction of each side wall 44. The fitting recess 44A is recessed inwardly from the side surface of the side wall 44, and a locking projection 46 projecting outward is formed on the inner surface of the fitting recess 44A.

Figure 13:
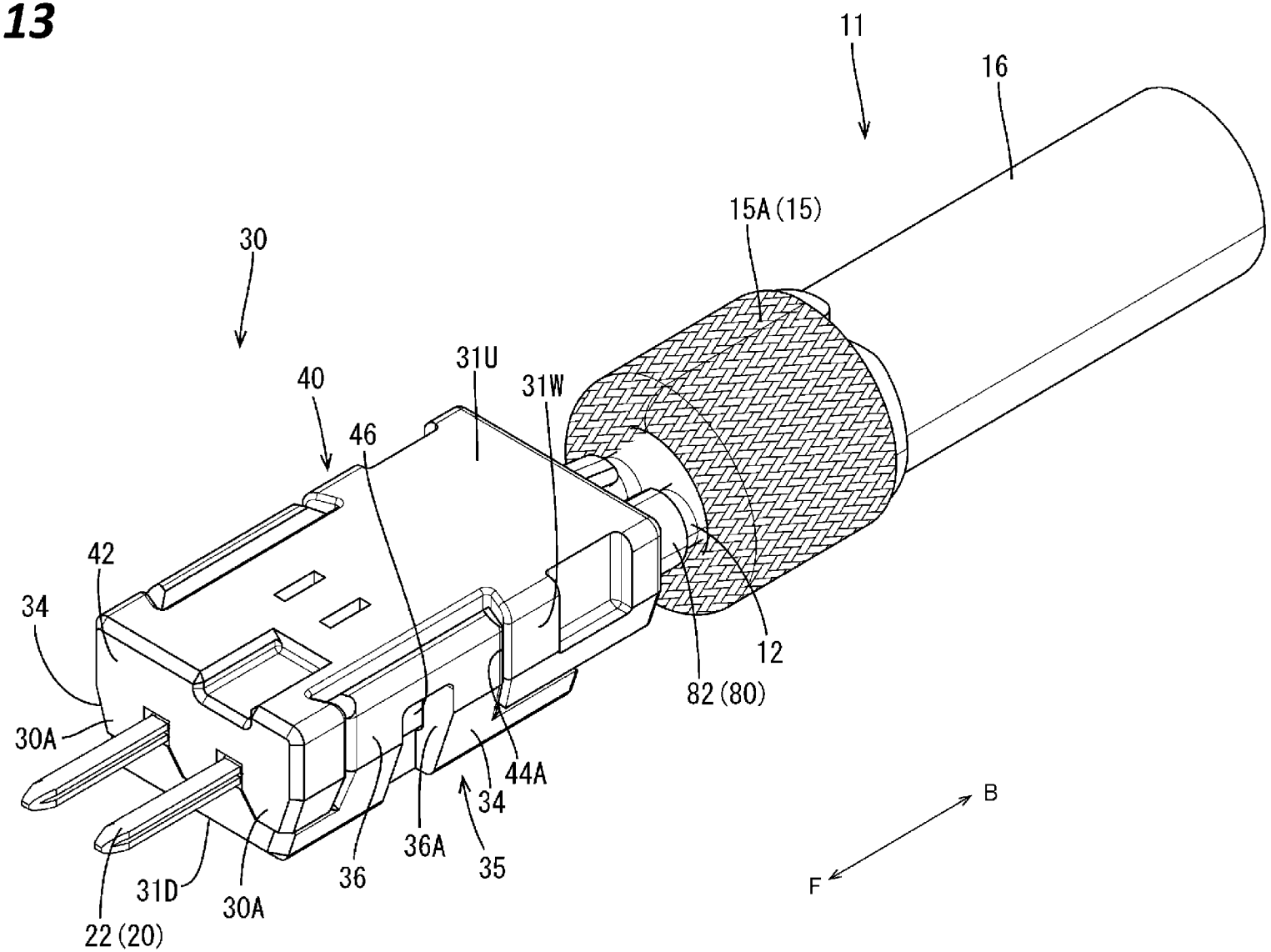
FIG. 13 is a perspective view showing a state where the inner conductors are accommodated in a terminal accommodating member.
Figure 15:
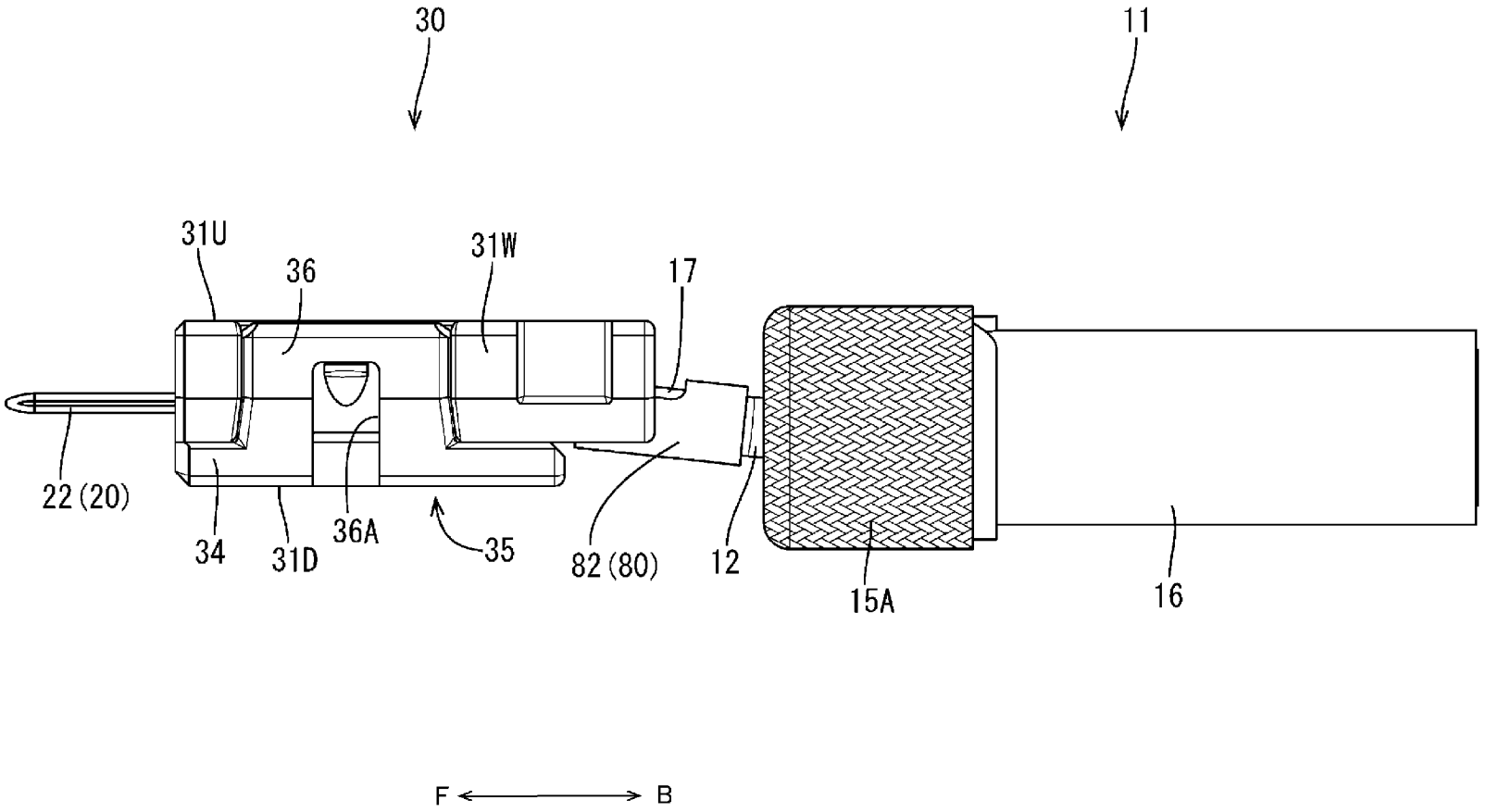
FIG. 15 is a side view showing a state where the inner conductors are accommodated in the terminal accommodating member.

The locking projections 46 are fit into the locking holes 36A of the locking pieces 36 to hold the upper member 40 and the lower member 35 in an assembled state as shown in FIGS. 13 and 15 when the upper member 40 and the lower member 35 are assembled and the locking pieces 36 of the lower member 35 are fit into the fitting recesses 44A.

As shown in FIGS. 19 to 22, the outer conductor 50 is composed of a first outer conductor 51 for covering the outer periphery of the terminal accommodating member 30 and a second outer conductor 60 to be assembled with the first outer conductor 51 to cover the outer peripheries of the first outer conductor 51 and the folded portion 15A of the shielded cable 11.

The first outer conductor 51 is formed by working a conductive metal plate material by a press or the like. As shown in FIG. 3, the first outer conductor 51 includes a tubular portion 52 for accommodating the terminal accommodating member 30 and a shield connecting portion 53 provided on the back end edge of a lower side of the tubular portion 52.

As shown in FIGS. 8 to 11, the tubular portion 52 is in the form of a rectangular tube having a substantially rectangular front view shape. An inner dimension in the lateral direction of the tubular portion 52 is slightly larger than a width in the lateral direction of the terminal accommodating member 30 and, as shown in FIG. 3, the terminal accommodating member 30 is fit and accommodated into the tubular portion 52 from behind.

The shield connecting portion 53 includes a linking piece 54 obliquely extending to a lower-back side from the back end edge of the lower side of the tubular portion 52 and a tongue piece 55 in the form of a substantially rectangular plate extending backward from the back end edge of the linking piece 54.

Figure 8:
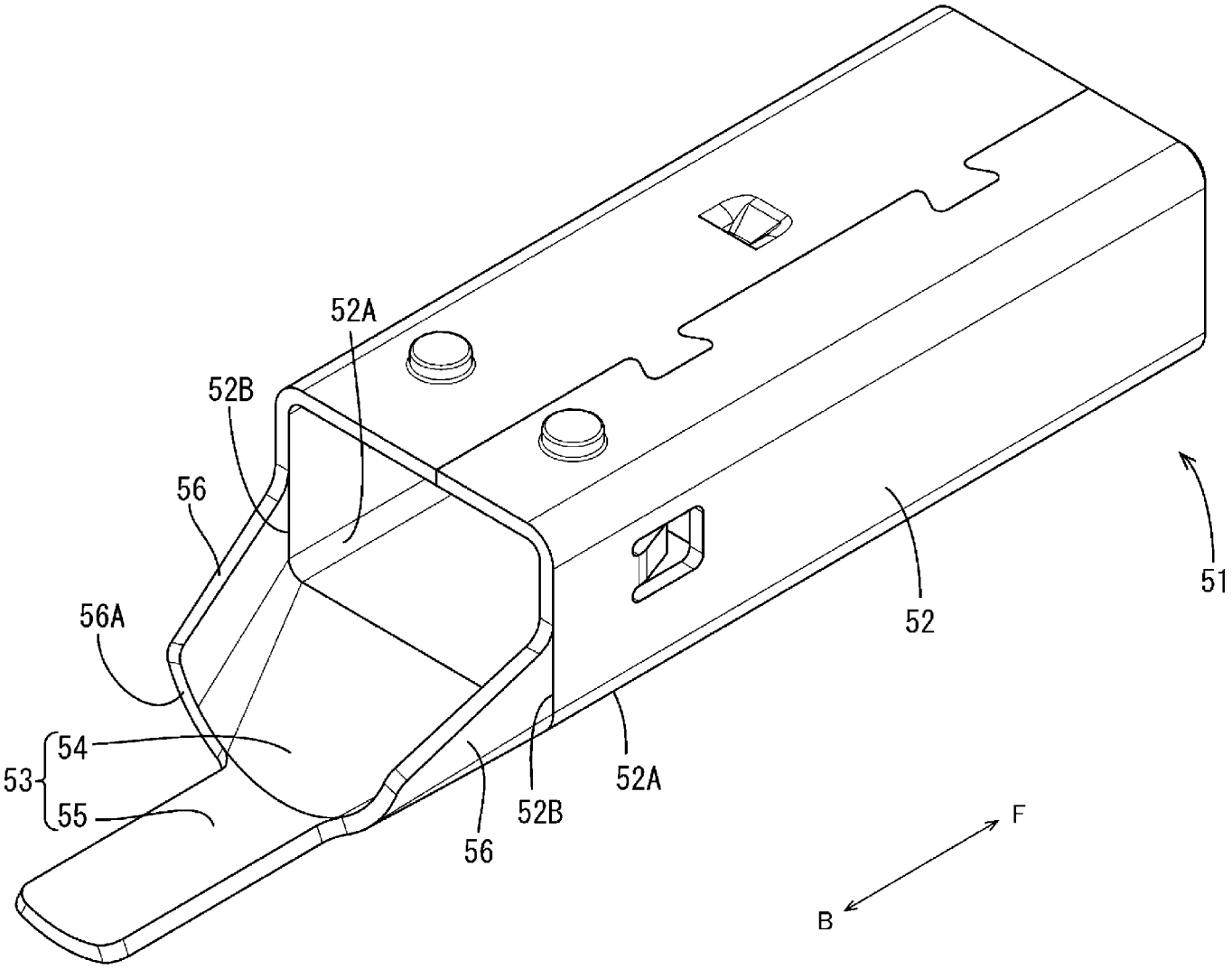
FIG. 8 is a perspective view of a first outer conductor.
Figure 9:
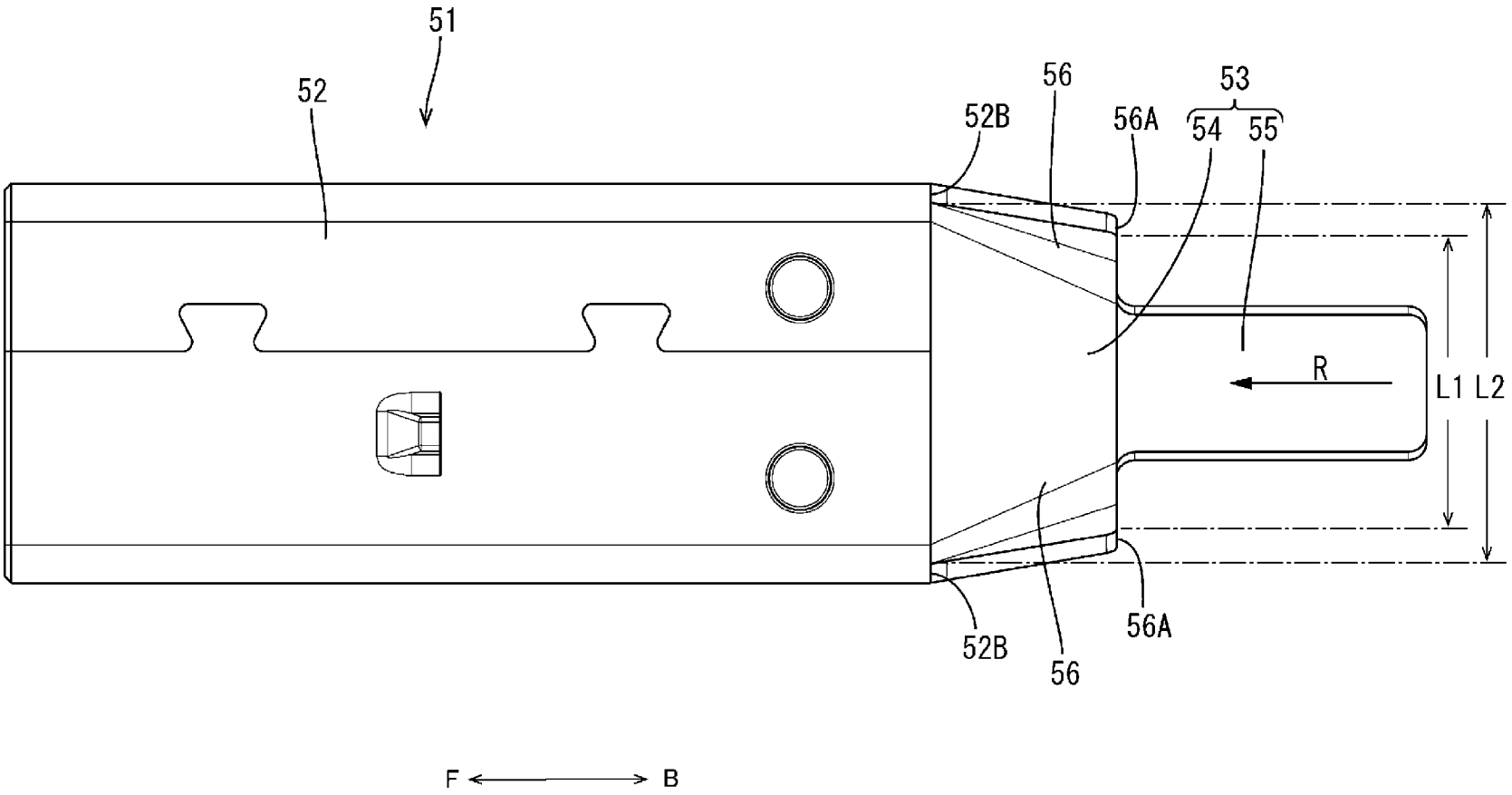
FIG. 9 is a plan view of the first outer conductor.
Figure 10:
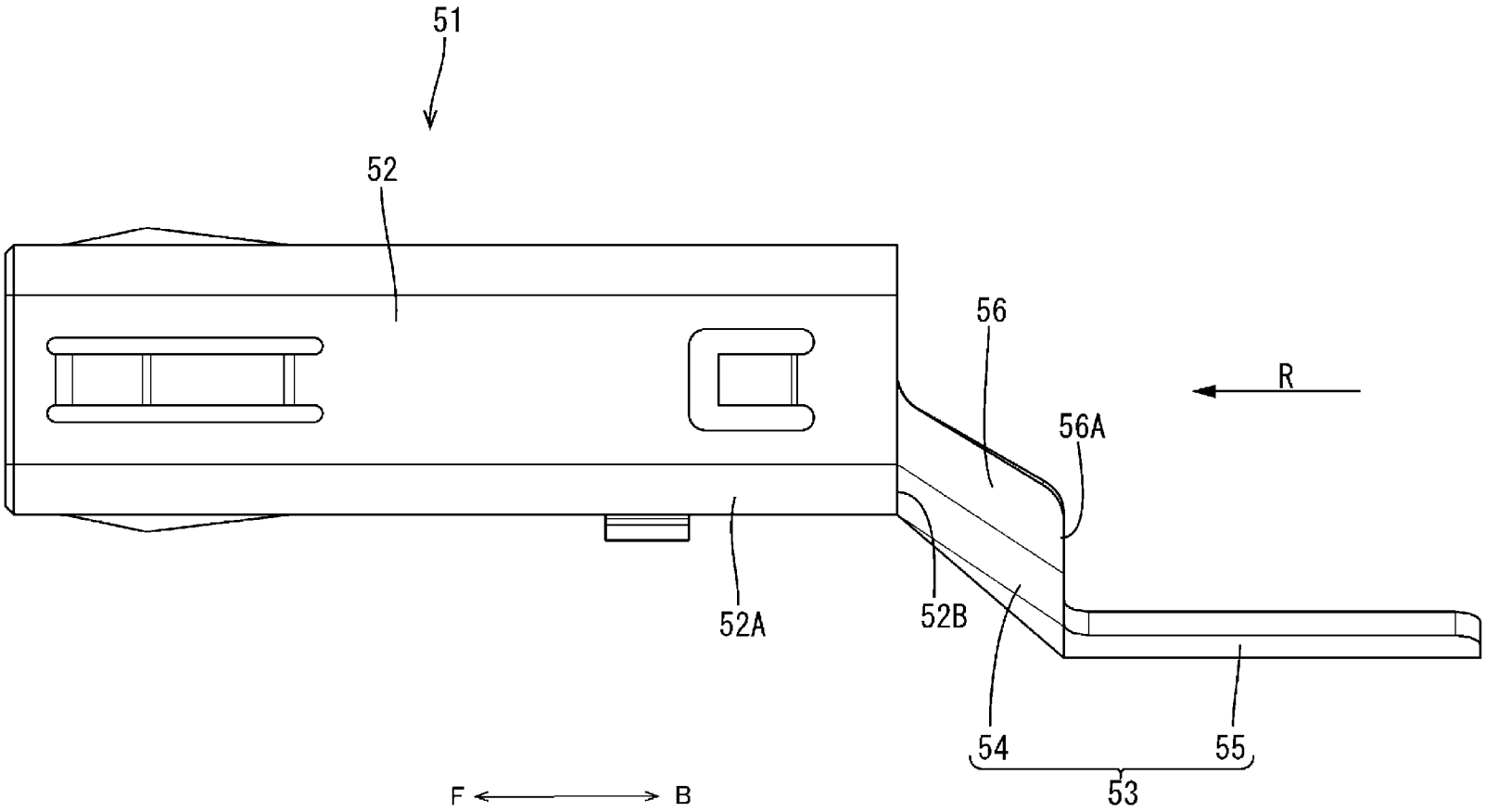
FIG. 10 is a side view of the first outer conductor.

As shown in FIGS. 8 and 9, the linking piece 54 is so formed that a width in the lateral direction is reduced from the back end edge of the lower side of the tubular portion 52 toward a back side, and formed into a shape slightly arched with an axis of the tubular portion 52 as a center.

Figure 17:
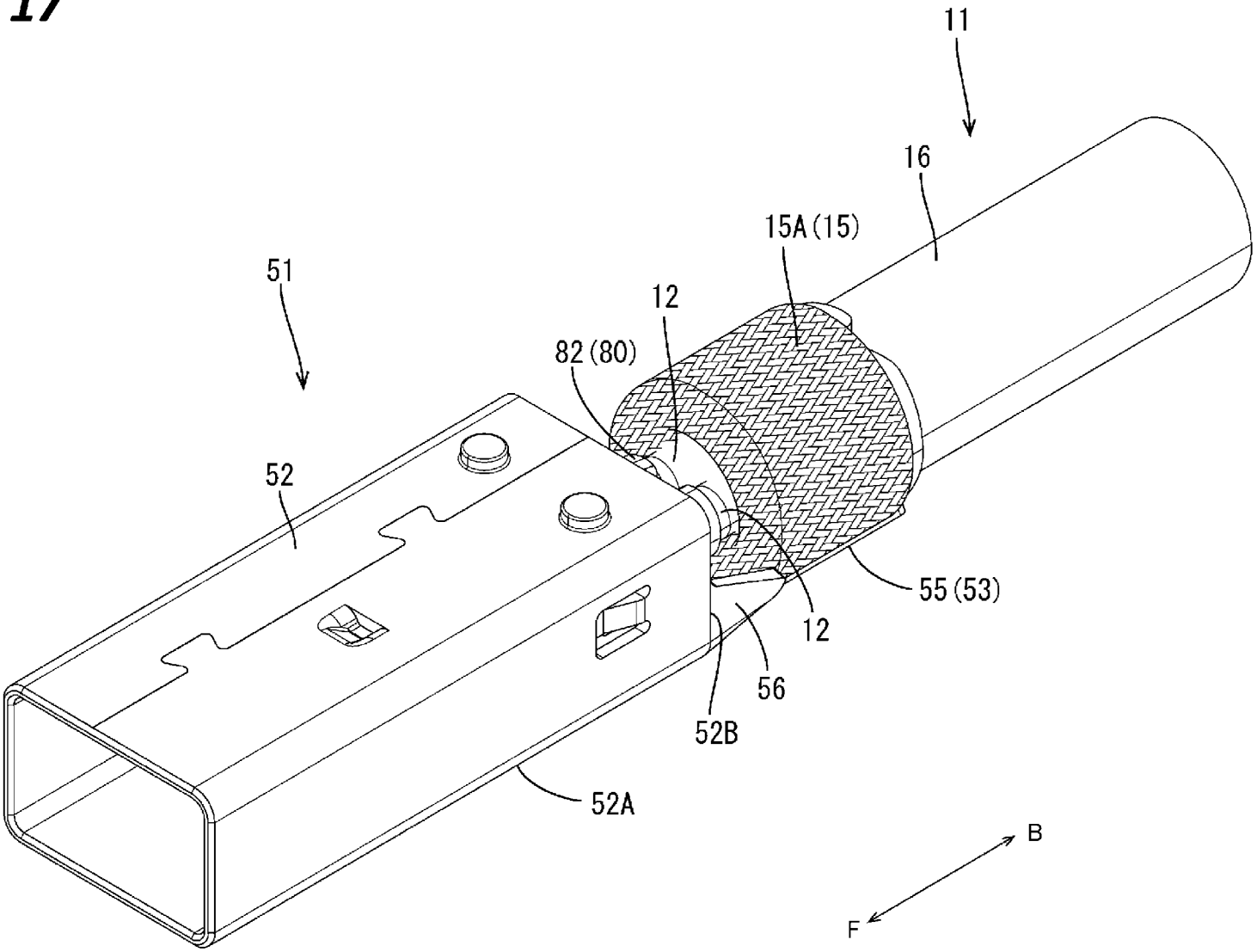
FIG. 17 is a perspective view showing a state where the terminal accommodating member is accommodated in a tubular portion.
Figure 18:
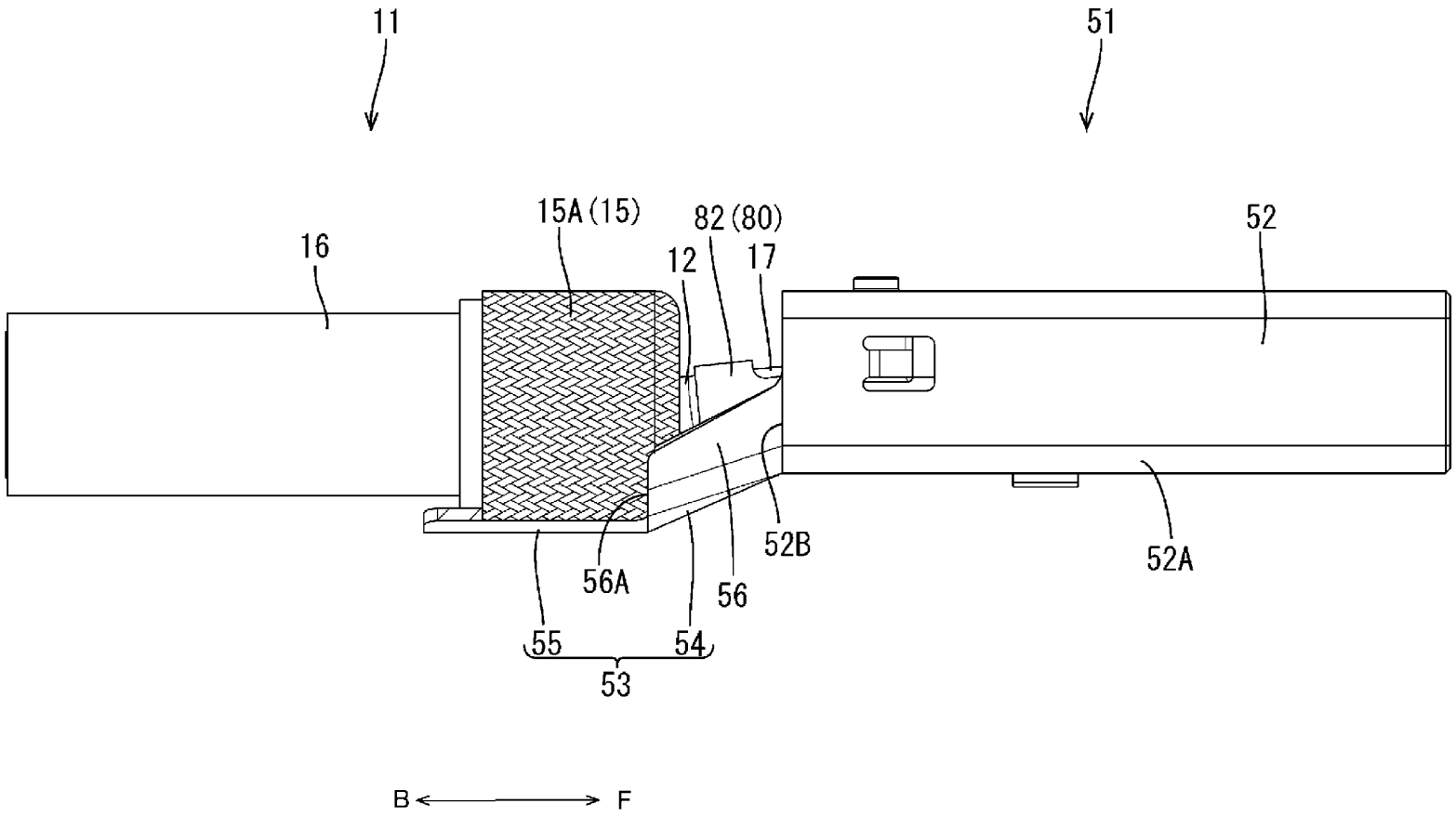
FIG. 18 is a side view showing the state where the terminal accommodating member is accommodated in the tubular portion.
Figure 19:
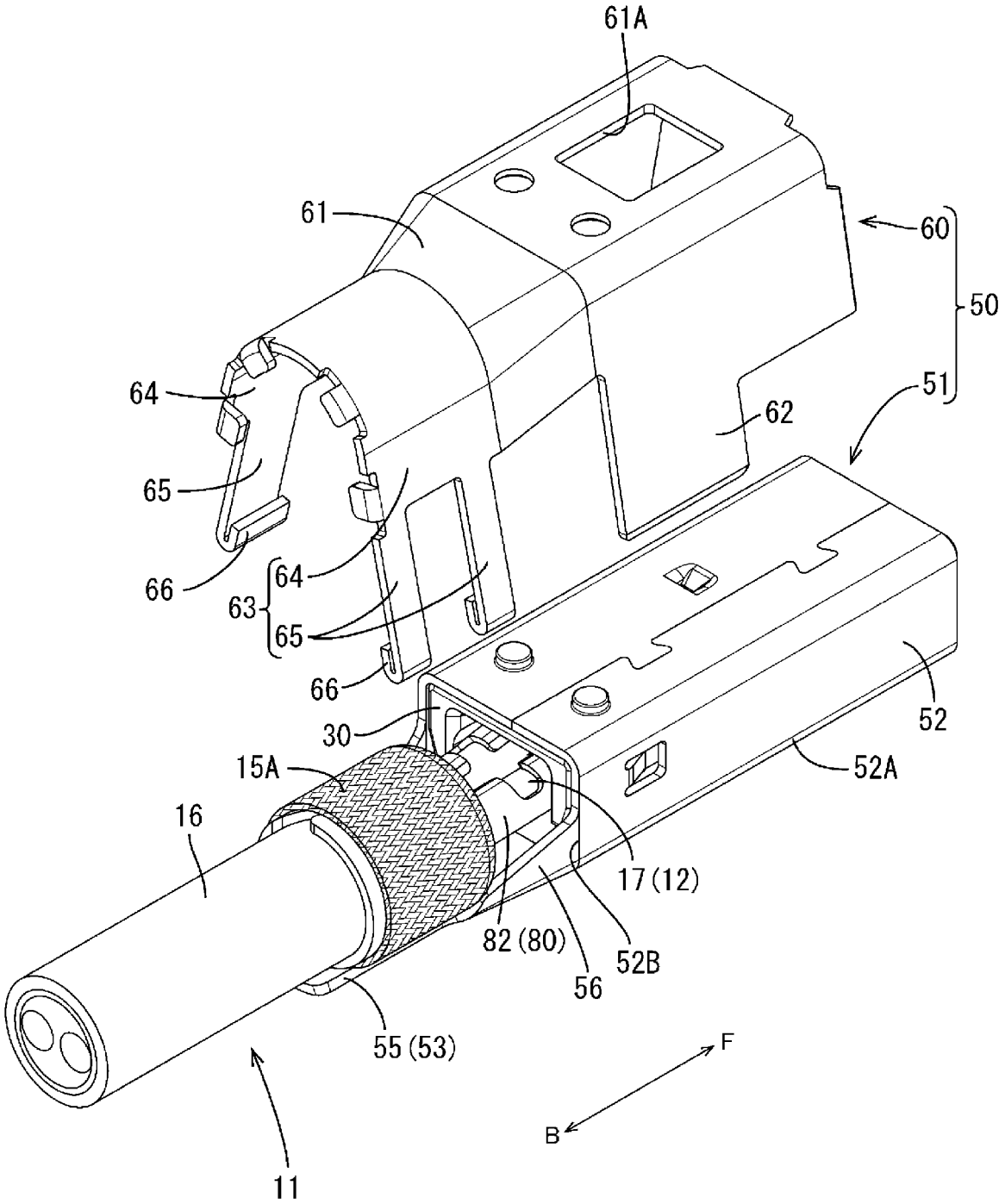
FIG. 19 is a perspective view showing a state before a second outer conductor is assembled with the first outer conductor.

The tongue piece 55 is formed into a shape somewhat arched with the axis of the tubular portion 52 as a center so as to be continuous with the arched back end edge of the linking piece 54. When the terminal accommodating member 30 is accommodated into the tubular portion 52, the tongue piece 55 is arranged below the folded portion 15A in the shielded cable 11 as shown in FIGS. 17 to 19.

The second outer conductor 60 is formed by working a conductive metal plate material by a press or the like. As shown in FIG. 19, the second outer conductor 60 includes a covering portion 61 extending from the tubular portion 52 to the position of the folded portion 15A of the shielded cable 11, a pair of fixing barrels 62 provided in a front part of the covering portion 61 and a pair of connection barrels 63 provided in a back part of the covering portion 61.

The covering portion 61 is dimensioned to cover a region from a back part of the tubular portion 52 to the folded portion 15A from above, and a lance hole 61A penetrating in the vertical direction is provided in the front part of the covering portion 61.

The pair of fixing barrels 62 are provided on both lateral side edge edges in the front part of the covering portion 61, and so crimped to the back part of the tubular portion 52 as to wind around the tubular portion 52 from both lateral sides.

The pair of connection barrels 63 are so provided on the both lateral side edges in the back part of the covering portion 61 as to be connected behind the pair of fixing barrels 62.

One of the pair of connection barrels 63 includes a side plate 64 to be arranged along one lateral side part of the folded portion 15A and a fixing piece 65 provided on the upper end of the side plate 64, and the other includes a side plate 64 to be arranged along the other lateral side part of the folded portion 15A and two fixing pieces 65 provided on the upper end of the side plate 64.

Figure 20:
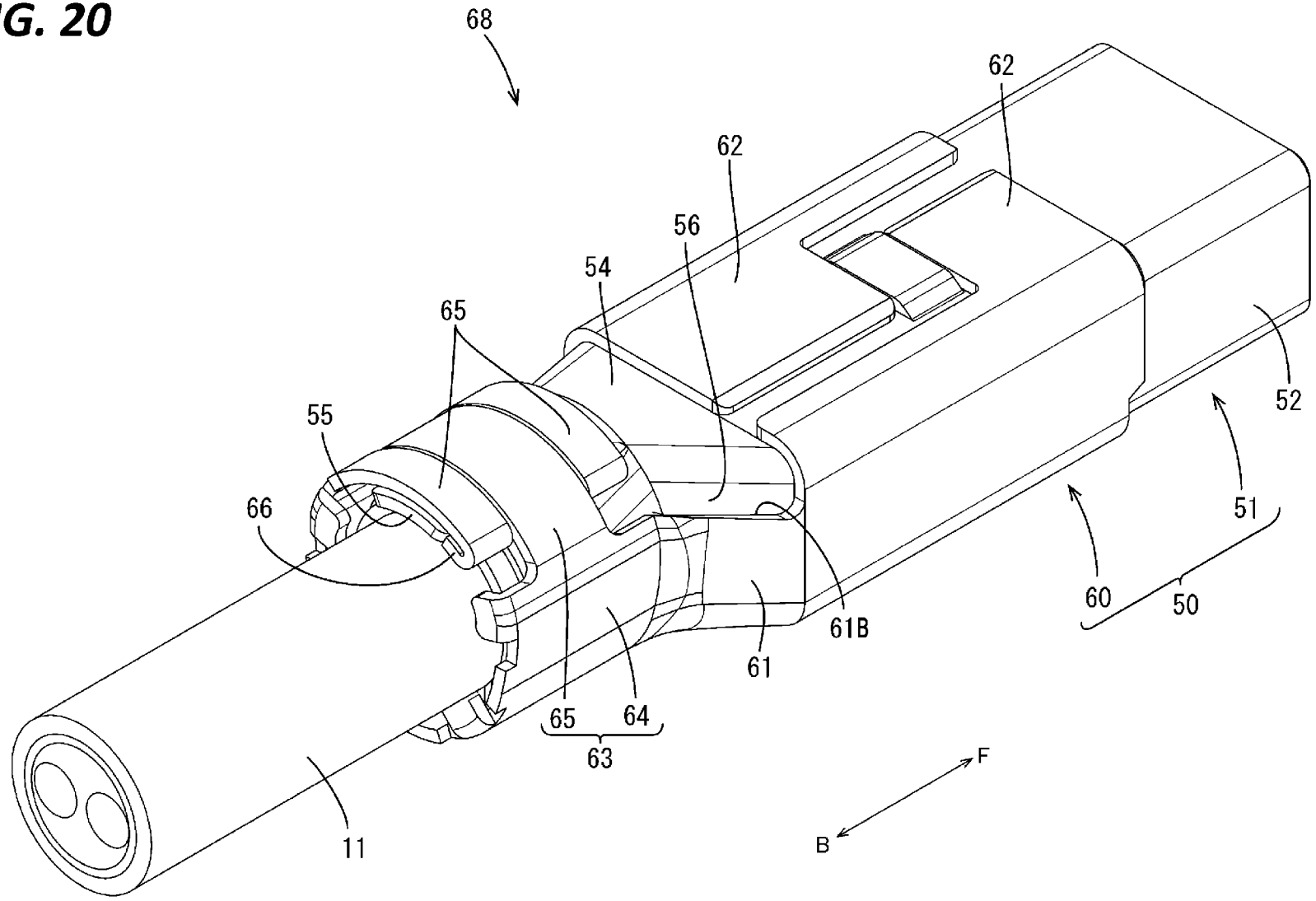
FIG. 20 is a perspective view of a vertically inverted terminal module.
Figure 21:
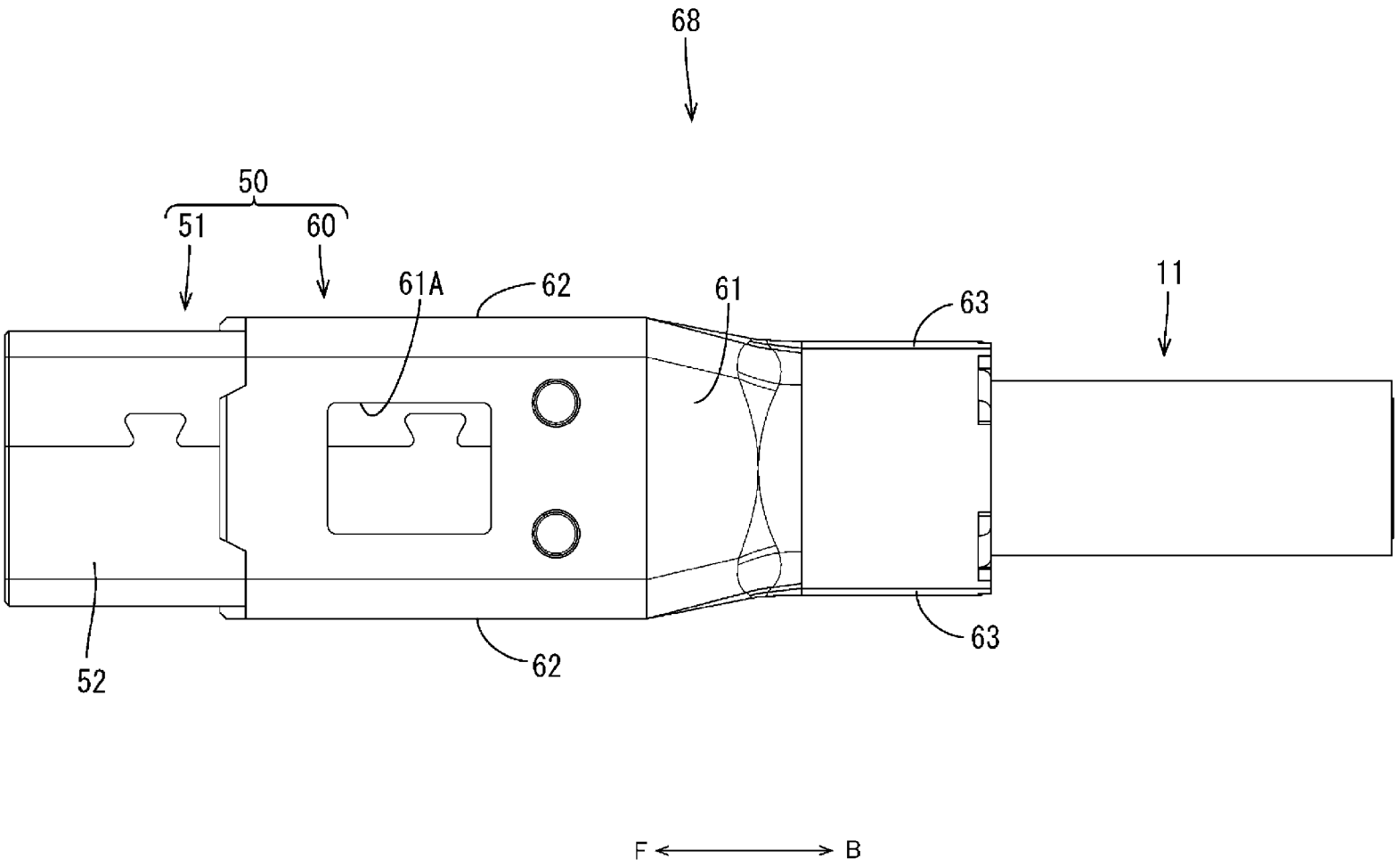
FIG. 21 is a plan view of the terminal module.
Figure 22:
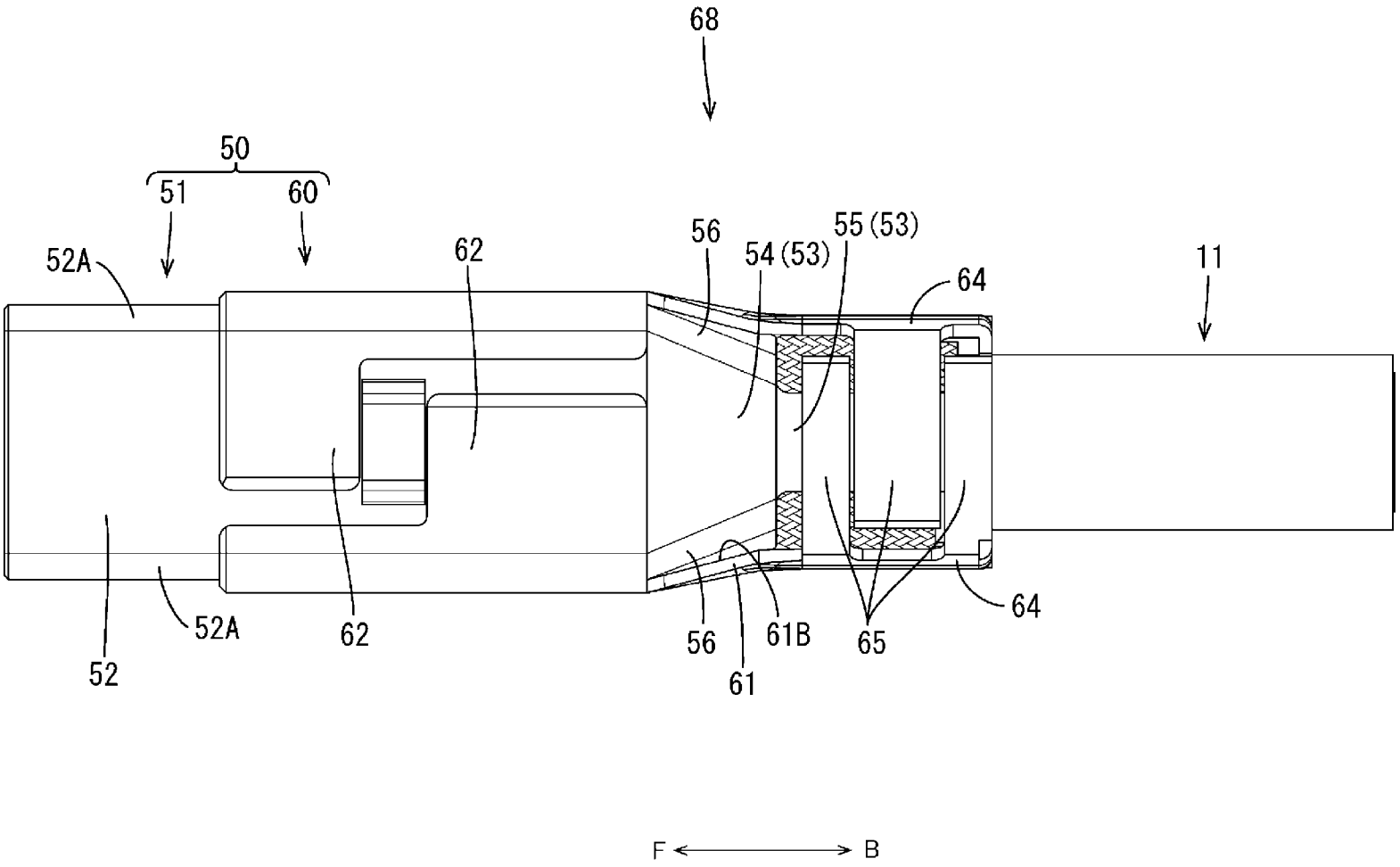
FIG. 22 is a bottom view of the terminal module.

As shown in FIGS. 20 and 22, the respective fixing pieces 65 are crimped and fixed to wind around the tongue piece 55 of the first outer conductor 51 arranged below the folded portion 15A and a lower part of the folded portion 15A.

Further, a hook portion 66 folded inwardly is formed on a tip part of each fixing piece 65.

As shown in FIG. 20, the hook portion 66 is hooked to either one of both lateral side edges of the tongue piece 55 when each fixing piece 65 is crimped, thereby fixing the fixing piece 65 so as not to be detached from the shield portion 15. In this way, the outer conductor 50 composed of the first and second outer conductors 51, 60 is electrically connected and fixed to the shield portion 15 of the shielded cable 11.

The housing 70 is made of synthetic resin and includes a module accommodating portion 72 for accommodating a terminal module 68 formed by mounting the inner conductors 20, the terminal accommodating member 30 and the outer conductor 50 on the end of the shielded cable 11 as shown in FIG. 3.

As shown in FIGS. 1 to 4, the module accommodating portion 72 is substantially in the form of a rectangular tube penetrating in the front-back direction, and a locking lance 73 lockable to an edge part of the lance hole 61A in the outer conductor 50 of the terminal module 68 is provided in the module accommodating portion 72. The locking lance 73 is fit into the lance hole 61A as shown in FIG. 3 if the terminal module 68 is accommodated at a proper accommodation position of the module accommodating portion 72, and the terminal module 68 is held in the housing 70 by the locking of the locking lance 73 and the edge part of the lance hole 61A.

As shown in FIGS. 8 to 11, narrowing portions 56 disposed along an inner peripheral surface 61B of the covering portion 61 of the second outer conductor 60 and extending toward the axis of the tubular portion 52 toward the back side in a direction in which the coated wires 12 extend out are respectively provided on back end edges 52B of lower angle parts 52A on both lateral sides of the tubular portion 52 of the first outer conductor 51.

The respective narrowing portions 56 are roundly formed to be continuous with the side edges of the linking piece 54 of the shield connecting portion 53 and, as shown in FIG. 9, a distance L1 between the narrowing portions 56 on both sides of the linking piece 54 is somewhat smaller than a width L2 in the lateral direction of a back end opening of the tubular portion 52.

Figure 11:
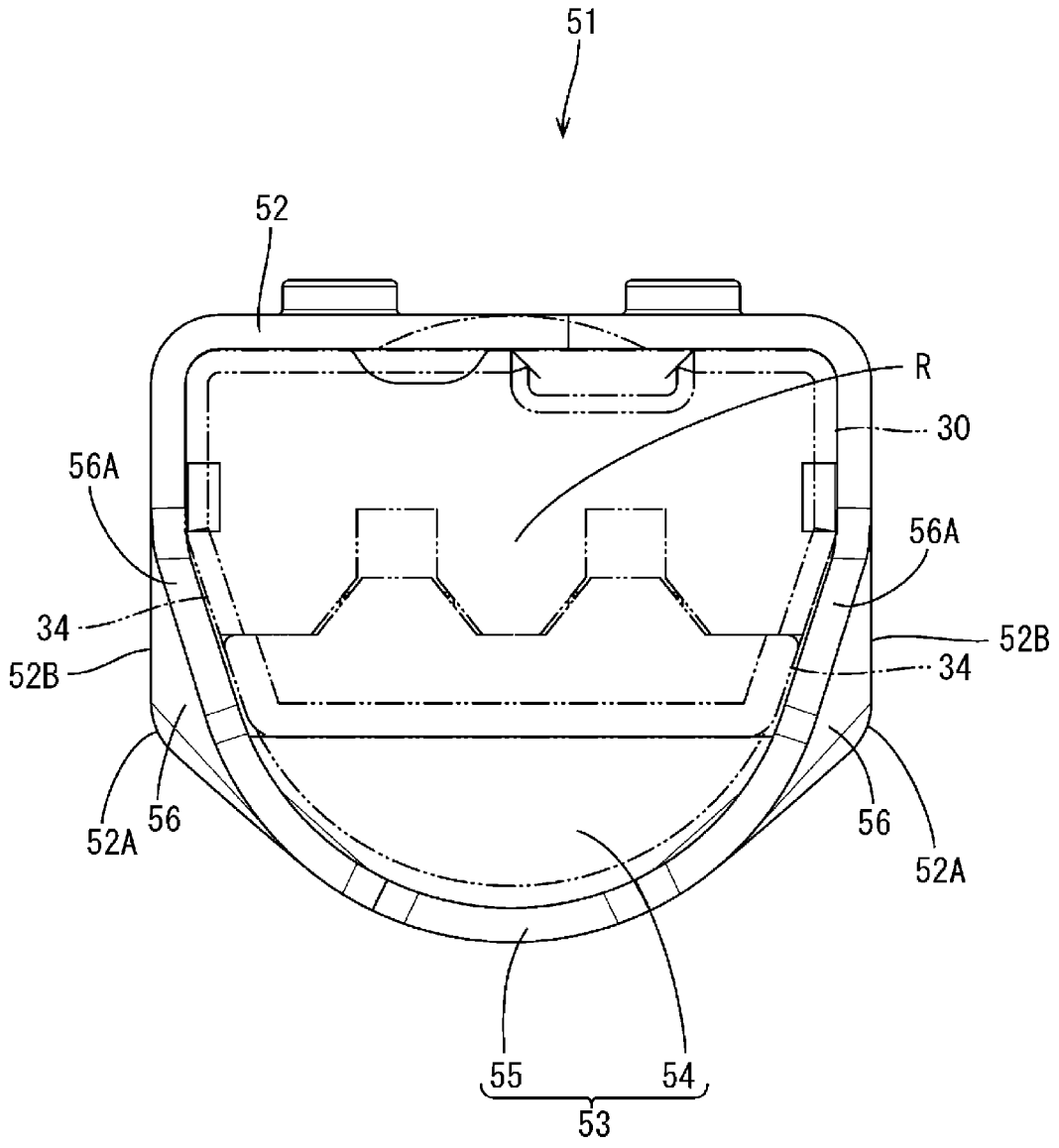
FIG. 11 is a back view of the first outer conductor.

Accordingly, if the first outer conductor 51 is viewed from behind, an insertion path R for the insertion of the terminal accommodating member 30 is narrower in the lateral direction in a lower part than in an upper part as shown in FIG. 11.

Further, since the narrowing portions 56 are roundly formed to be continuous with the side edges of the linking piece 54 on the back end edges 52B of the lower angle parts 52A on both lateral sides in the tubular portion 52, the pair of fixing barrels 62 of the second outer conductor 60 are crimped to the back part of the tubular portion 52. If the pair of connection barrels 63 are crimped to the folded portion 15A, the narrowing portions 56 are disposed along the inner peripheral surface 61B of the covering portion 61 of the second outer conductor 60 as shown in FIGS. 20 and 22 so that clearances among the back end part of the tubular portion 52, the narrowing portions 56 and the covering portion 61 can be reduced.

On the other hand, as shown in FIGS. 13 to 16, escaping portions 34 for avoiding the interference of the terminal accommodating member 30 with the narrowing portions 56 in the process of accommodating the terminal accommodating member 30 into the tubular portion 52 of the first outer conductor 51 are respectively formed in lower corner parts 30A on both lateral sides of the terminal accommodating member 30.

Each escaping portion 34 is formed by recessing the outer surfaces of the side wall 31W and the lower wall 31D of the terminal accommodating member 30, and provided over the entire length of the terminal accommodating member 30 in an inserting direction of the terminal accommodating member 30 (front-back direction). Further, as shown in FIG. 11, each escaping portion 34 is inclined inwardly toward a lower side to have the same inclined state when a back end edge 56A of the narrowing portion 56 of the first outer conductor 51 is viewed from behind.

Further, as shown in FIGS. 4 to 7, the escaping portions 34 in the terminal accommodating member 30 are formed on the lower end edges 44B of the side walls 44 of the upper member 40 and on both side edges 35DW in the lateral direction of the bottom wall 35D of the lower member 35 and lower edge parts 36B of the locking pieces 36. As shown in FIGS. 13 to 16, these escaping portions 34 are integrated by assembling the upper member 40 and the lower member 35 in the vertical direction, and the escaping portions 34 are formed over the entire length in the front-back direction in the lower corner parts 30A on both sides in the lateral direction of the terminal accommodating member 30.

Figure 14:
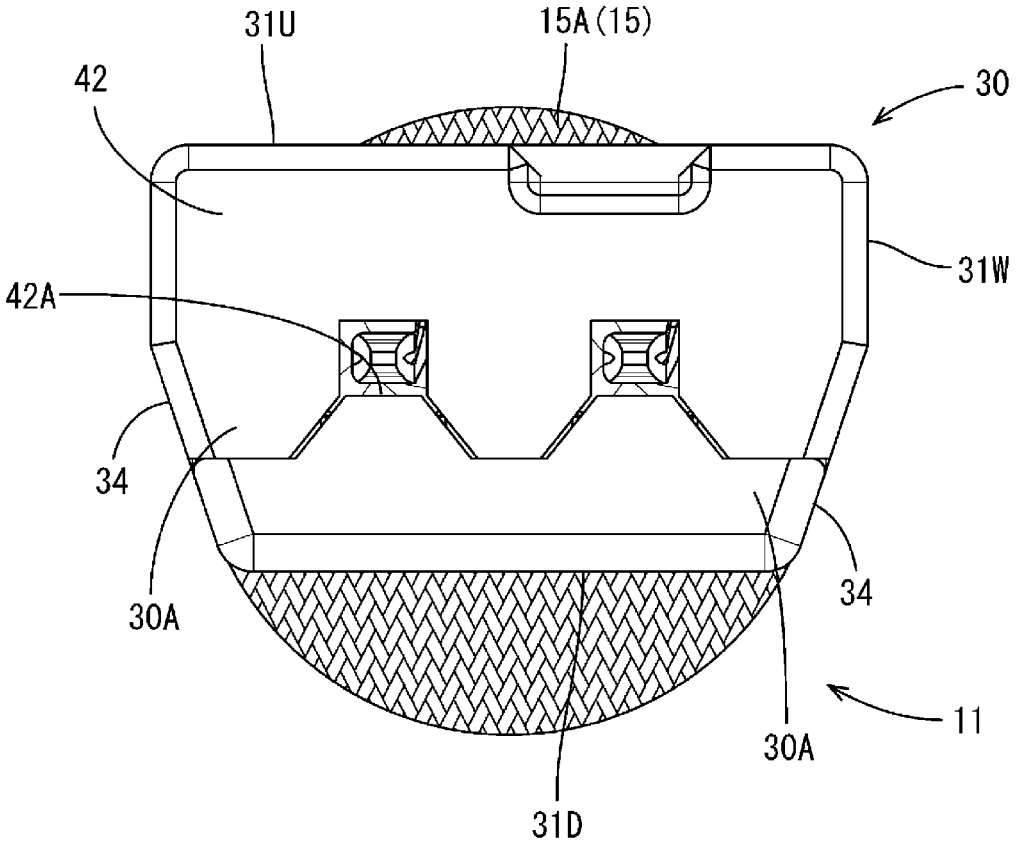
FIG. 14 is a front view showing the state where the inner conductors are accommodated in the terminal accommodating member.

Accordingly, the terminal accommodating member 30 is narrower in the lateral direction in a lower part than in an upper part and, as shown in FIG. 14, the lower part of the terminal accommodating member 30 has an inverted trapezoidal shape in a front view. Further, the escaping portions 34 of the terminal accommodating member 30 pass inside the narrowing portions 56 in the process of accommodating the terminal accommodating member 30 into the tubular portion 52 of the first outer conductor 51, whereby it can be avoided that the terminal accommodating member 30 cannot be inserted into the tubular portion 52.

This embodiment is configured as described above. Next, an example of an assembling procedure of the connector 10 for communication is briefly described and, then, functions and effects of the connector 10 are described.

First, the sheath portion 16 of the shielded cable 11 is stripped to expose the ends of the two coated wires 12 and the shield portion 15, and the shield portion 15 is folded on the outer surface of the sheath portion 16 to form the folded portion 15A. Further, the insulation coatings 14 of the front end parts of the two coated wires 12 are stripped to expose the cores 13 and the inner conductors 20 are connected by crimping the wire connecting portions 24 to the exposed cores 13.

Subsequently, the adjusting member 80 is mounted on the exposed portions 17 of the two coated wires 12 of the shielded cable 11. Here, in a developed state before being mounted on the exposed portions 17, the adjusting member 80 is in such a state that an upper part constituting the adjusting bodies 82 is open upward as shown in FIG. 4. The exposed portions 17 of the coated wires 12 are arranged on the adjusting member 80 with the open adjusting bodies 82, and the adjusting bodies 82 are crimped to wind around the exposed portions 17, whereby the adjusting member 80 is fixed to the exposed portions 17.

Subsequently, as shown in FIG. 12, the two inner conductors 20 are mounted on the ceiling wall 40U of the vertically inverted upper member 40 and the lower member 35 is assembled with the upper member 40 from above. In this way, the inner conductors 20 are accommodated into the terminal accommodating member 30 as shown in FIGS. 13 to 16.

Here, if the lower member 35 is assembled with the upper member 40, the escaping portions 34 formed on the lower end edges 44B of the side walls 44 of the upper member 40 and the escaping portions 34 formed on the both lateral side edges 35DW of the bottom wall 35D and the lower edge parts 36B of the locking pieces 36 of the lower member 35 are integrated and the escaping portions 30 extending over the entire length of the terminal accommodating member 30 in the front-back direction are formed in the lower corner parts 30A on both lateral sides of the lower side of the terminal accommodating member 30.

Subsequently, as shown in FIGS. 16 to 19, the terminal accommodating member 30 is inserted into the tubular portion 52 in the first outer conductor 51 of the outer conductor 50 from behind and the second outer conductor 60 is assembled with the first outer conductor 51.

The second outer conductor 60 is assembled by mounting the covering portion 61 of the second outer conductor 60 on the first outer conductor 51 from above such that the tongue piece 55 of the first outer conductor 51 is on a lower side and crimping the fixing barrels 62 to wind around the tubular portion 52. Further, the respective fixing pieces 65 of the connection barrels 63 are crimped to wind around the tongue piece 55 and the shield portion 15.

Here, if the pair of fixing barrels 62 are crimped to the back part of the tubular portion 52 and the pair of connection barrels 63 are crimped to the folded portion 15A, the inner peripheral surface 61B of the covering portion 61 of the second outer conductor 60 can be disposed along the narrowing portions 56 and the clearances among the back end part of the tubular portion 52, the narrowing portions 56 and the covering portion 61 can be reduced as shown in FIGS. 20 and 22 since the narrowing portions 56 are roundly formed to be continuous with the side edges of the linking piece 54 on the back end edges 52B of the lower angle parts 52A on the both lateral sides in the tubular portion 52. In this way, it is possible to suppress the leakage of noise and the entrance of noise from outside through the clearances among the back end part of the tubular portion 52, the narrowing portions 56 and the covering portion 61 and suppress a reduction in communication quality.

Further, if the respective fixing pieces 65 are crimped, the hook portions 66 of the fixing pieces 65 are hooked to the side edges of the tongue piece 55 as shown in FIG. 20, whereby the fixing pieces 65 are so fixed as not to be detached from the tongue piece 55 and the shield portion 15 and the terminal module 68 formed by assembling the inner conductors 50, the terminal accommodating member 30 and the outer conductor 50 on the end of the shielded cable 11 is completed.

Finally, the terminal module 68 is inserted into the module accommodating portion 72 of the housing 70 from behind. If the terminal module 68 reaches a proper accommodation position, the locking lance 73 is fit into the lance hole 61A of the outer conductor 50 and the terminal module 68 is retained and held in the housing 70 as shown in FIG. 3. In this way, the connector 10 for communication is completed.

Next, functions and effects of the connector 10 for communication are described.

If a back end part of a tubular portion of a first outer conductor is covered by a covering portion of a second outer conductor as in this embodiment, communication quality is reduced due to the leakage of noise and the entrance of noise from outside through a clearance if the clearance between the tubular portion and the covering portion is large. Accordingly, it is considered to reduce the clearance between the first and second outer conductors by forming narrowing portions extending radially inward toward a back side on a back end part of the tubular portion and causing the covering portion to extend along the narrowing portions. However, if the narrowing portions are formed in the end part of the tubular portion, there is a concern that the narrowing portions and the terminal accommodating member interfere to deteriorate an assembling operation of inserting the terminal accommodating member into the tubular portion when the terminal accommodating member is inserted into the tubular portion.

Figure 16:
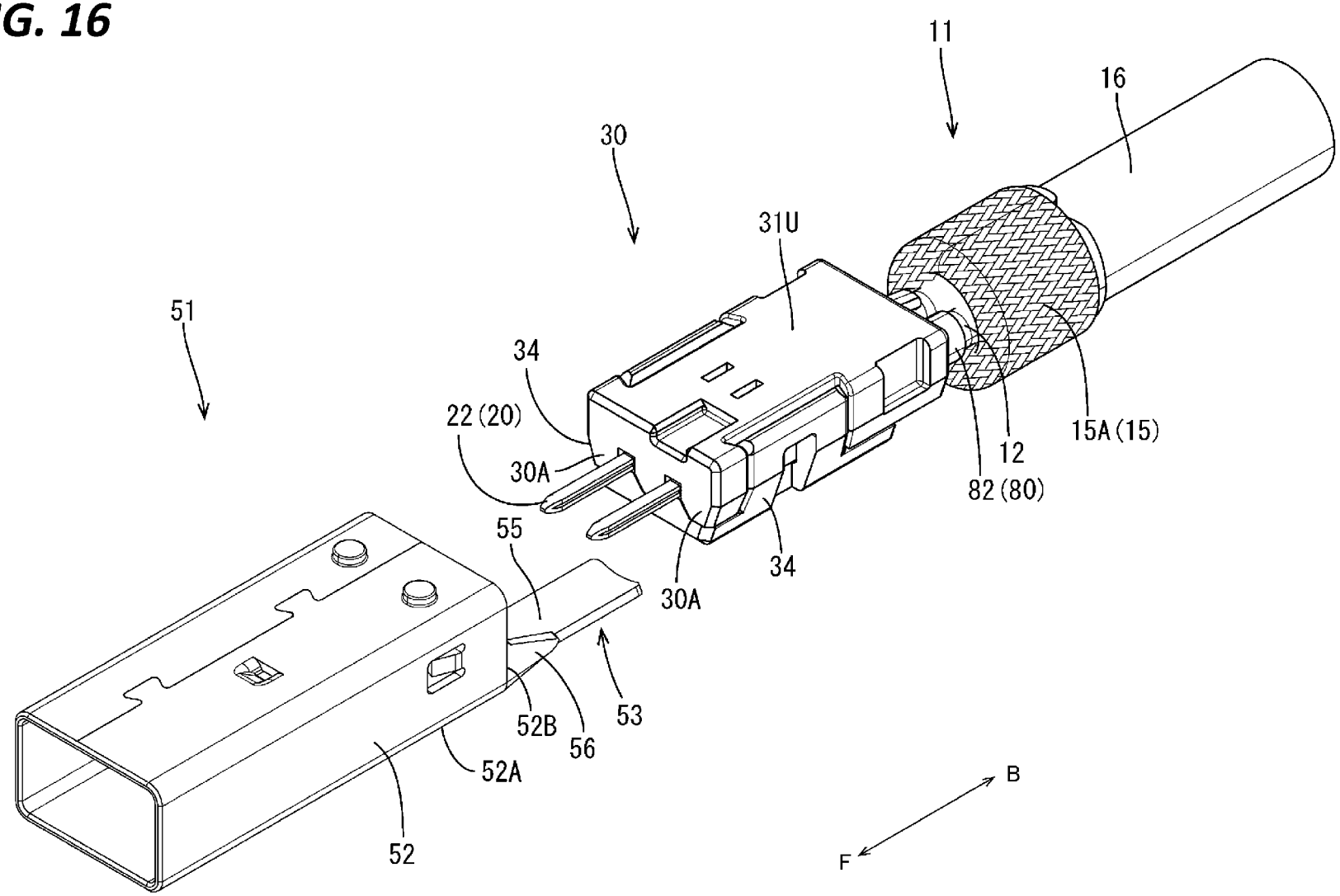
FIG. 16 is a perspective view showing a state before the terminal accommodating member is assembled with the first outer conductor.

Accordingly, the present inventor and other researchers diligently studied to solve the above problem and, as a result, found out the configuration of this embodiment. That is, in the connector 10 of this embodiment, the terminal module 68 is provided with the shielded cable 11 including at least one coated wire 12, the conductive shield portion 15 for covering the outer peripheries of the coated wires 12 and the sheath portion 16 for covering the outer periphery of the shield portion 15, the inner conductors 20 to be connected to the coated wires 12, the terminal accommodating member 30 made of resin for accommodating the inner conductors 20, the coated wires 12 extending out from the terminal accommodating member 30, the first outer conductor 51 made of metal and including the tubular portion 52 for accommodating the terminal accommodating member 30, the coated wires 12 extending out from the tubular portion 52, and the second outer conductor 60 made of metal and including the covering portion 61 for covering the back end part of the tubular portion 52 of the first outer conductor 51 on the side toward which the coated wires 12 extend, the narrowing portions 56 disposed along the inner peripheral surface 61B of the covering portion 61 of the second outer conductor 60 as shown in FIG. 16 and extending toward the axis of the tubular portion 52 toward the back side in the direction in which the coated wires 12 extend are provided in the back end part of the first outer conductor 51, the terminal accommodating member 30 includes the escaping portions 34 provided by recessing the outer surfaces of the lower wall 31D and the side walls 31W of the terminal accommodating member 30 and configured to avoid interference with the narrowing portions 56 in the process of accommodating the terminal accommodating member 30 into the tubular portion 52.

That is, according to this embodiment, since the covering portion 61 of the second outer conductor 60 can be arranged along the narrowing portions 56 provided on the back end edges 52B of the tubular portion 52 of the first outer conductor 51 as shown in FIGS. 20 and 22, it is possible to suppress the leakage of noise and the entrance of noise from outside through the clearances among the tubular portion 52 of the first outer conductor 51, the narrowing portions 56 and the covering portion 61 of the second outer conductor 60. In this way, a reduction in communication quality in the terminal module 68 can be suppressed.

Further, since the terminal accommodating member 30 is provided with the escaping portions 34, the interference of the narrowing portions 56 and the terminal accommodating member 30 can be avoided in the process of accommodating the terminal accommodating member 30 into the tubular portion 52 of the first outer conductor 51 as shown in FIG. 11. In this way, the deterioration of assembling workability in assembling the terminal accommodating member 30 with the first outer conductor 51 can be suppressed.

Further, the tubular portion 52 is formed into a rectangular tube shape, the narrowing portions 56 are roundly formed to be continuous with the back end edges 52B of the lower angle parts 52A of the tubular portion 52, the terminal accommodating member 30 is formed into a rectangular parallelepiped shape (rectangular column shape) and the escaping portions 34 are formed along the front-back direction, which is the inserting direction of the terminal accommodating member 30, in the lower corner parts 30A of the terminal accommodating member 30 on the sides of the narrowing portions 56.

Generally, if a back end part of a tubular portion in the form of a rectangular tube is covered by a covering portion, clearances are easily formed between angle parts of the tubular portion and the covering portion.

However, according to this embodiment, since the narrowing portions 56 are roundly formed on the back end edges 52B of the lower angle parts 52A of the tubular portion 52 as shown in FIGS. 8 and 11, the clearances among the back end part of the tubular portion 52, the narrowing portions 56 and the covering portion 61 can be reduced. In this way, it is possible to suppress the leakage of noise and the entrance of noise from outside through the clearances among the back end part of the tubular portion 52, the narrowing portions 56 and the covering portion 61 and suppress a reduction in communication quality.

Further, since the escaping portions 34 are roundly provided in the lower corner parts 30A in the terminal accommodating member 30, the escaping portions 34 can double as erroneous assembling preventing portions for preventing so-called erroneous assembling such as the assembling of the vertically inverted terminal accommodating member 30.

Other Embodiments

The technique disclosed in this specification is not limited to the above described and illustrated embodiment and includes, for example, the following various modes.

(1) In the above embodiment, the narrowing portions 56 are formed to be continuous with the linking piece 54 of the shield connecting portion 53 on the back end edge of the lower side of the tubular portion 52. However, without limitation to this, narrowing portions may be formed independently of a linking piece.

(2) In the above embodiment, one shield connecting portion 53 is formed on the back end edge of the lower side of the tubular portion 52. However, without limitation to this, a plurality of shield connecting portions may be formed on the back end edge of the tubular portion 52.

Figure 23:
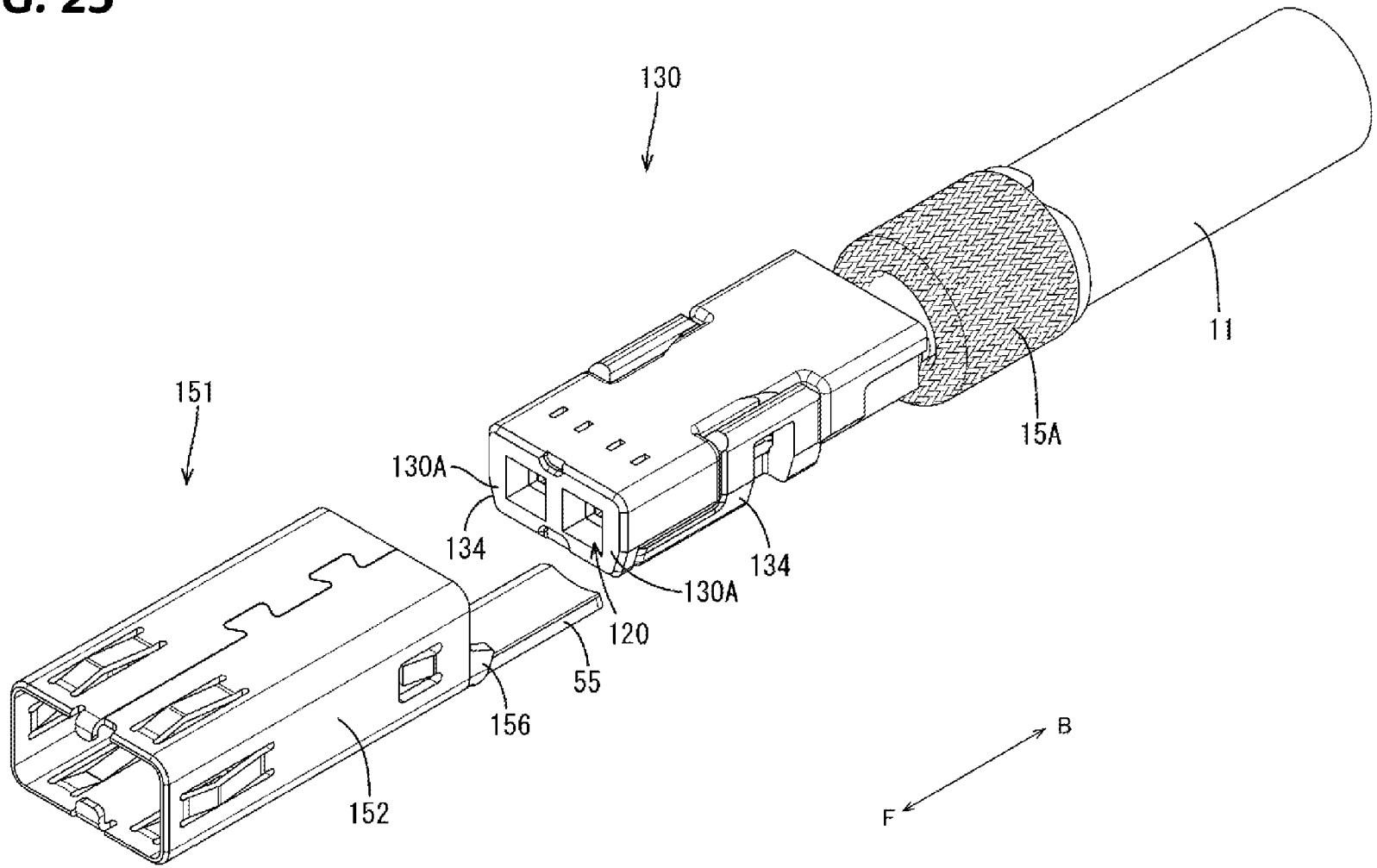
FIG. 23 is a perspective view showing a state before a terminal accommodating member is assembled with a first outer conductor according to another embodiment.

(3) In the above embodiment, the inner conductors 20 are configured as male terminals. However, without limitation to this, inner conductors 120 may be configured as female terminals as shown in FIG. 23. Moreover, the terminal accommodating member 30, the lower corner part 30A, the escaping portion 34, the first outer conductor 51, the tubular portion 52 and the narrowing portion 56 of FIG. 16 may correspond to the reference characters 130, 130A, 134, 151, 152 and 156 of FIG. 23, respectively.

List of Reference Numerals

10: connector
12: coated wire
15: shield portion
16: sheath portion
20: inner conductor
30: terminal accommodating member
30A: lower corner part (example of "corner part")
34: escaping portion
51: first outer conductor
52: tubular portion
52A: lower angle part (example of "angle part")
52B: back end edge (example of "end part")
56: narrowing portion
60: second outer conductor
61: covering portion
68: terminal module
70: housing

What is claimed is:

1. A terminal module, comprising:

a shielded cable including at least one coated wire, a conductive shield portion for covering an outer periphery of the coated wire and a sheath portion for covering an outer periphery of the shield portion;

an inner conductor to be connected to the coated wire;

a terminal accommodating member made of resin for accommodating the inner conductor, the coated wire extending out from the terminal accommodating member;

a first outer conductor made of metal and including a tubular portion for accommodating the terminal accommodating member, the coated wire extending out from the tubular portion; and a second outer conductor made of metal and including a covering portion for covering an end part of the tubular portion of the first outer conductor on a side where the coated wire extends out, wherein:

a narrowing portion disposed along an inner peripheral surface of the covering portion of the second outer conductor and extending toward an axis of the tubular portion along a direction in which the coated wire extends out is provided in the end part of the first outer conductor, and the terminal accommodating member includes an escaping portion provided by recessing an outer surface of the terminal accommodating member, the escaping portion avoiding interference with the narrowing portion in the process of accommodating the terminal accommodating member into the tubular portion.

2. The terminal module of claim 1, wherein:

the tubular portion is formed into a rectangular tube shape and the narrowing portion is roundly formed to be continuous with an angle part of the tubular portion, the terminal accommodating member is formed into a rectangular column shape, and the escaping portion is formed along an inserting direction of the terminal accommodating member in a corner part of the terminal accommodating member on the narrowing portion side.

3. A connector, comprising:

the terminal module of claim 1; and a housing for accommodating the terminal module.

* * * * *